US012697524B2

(12) United States Patent
Gray et al.

(10) Patent No.: US 12,697,524 B2
(45) Date of Patent: Aug. 4, 2026

(54) ADJUSTABLE CENTER MASS WEIGHT APPARATUS

(71) Applicant: Gray Performance Enterprises, LLC, Woodbury, NJ (US)

(72) Inventors: Keith Bradley Gray, Woodbury, NJ (US); Kirk Russell Gray, Wadsworth, OH (US)

( * ) Notice: Subject to any disclaimer, the term of this patent is extended or adjusted under 35 U.S.C. 154(b) by 75 days.

(21) Appl. No.: 18/820,337

(22) Filed: Aug. 30, 2024

(65) Prior Publication Data

US 2026/0061247 A1 Mar. 5, 2026

(51) Int. Cl.
*A63B 21/075* (2006.01)

(52) U.S. Cl.
CPC ..... *A63B 21/075* (2013.01)

(58) Field of Classification Search
CPC ..... A63B 21/075; A63B 21/06; A63B 21/00
See application file for complete search history.

(56) References Cited

U.S. PATENT DOCUMENTS 7,326,158 B1 * 2/2008 Wang ..... A63B 43/02 482/8
9,573,014 B2 * 2/2017 Sorin ..... A63B 21/4035
9,713,736 B2 * 7/2017 Kao ..... A63B 23/12
10,010,470 B2 * 7/2018 Bradford ..... A63B 23/1281
10,569,120 B2 * 2/2020 Sorin ..... A63B 21/4035
2012/0157270 A1 * 6/2012 Johnson ..... A63B 21/072 482/93
2019/0269981 A1 * 9/2019 Jordan ..... A63B 39/00
2025/0235734 A1 * 7/2025 Dunbar ..... A63B 21/075

FOREIGN PATENT DOCUMENTS

WO WO-0158533 A2 * 8/2001 ..... A63B 21/0728

* cited by examiner

*Primary Examiner* — Andrew M Kobylarz
(74) *Attorney, Agent, or Firm* — Ashok Tankha

(57) ABSTRACT

An adjustable center mass weight apparatus includes a generally spherical, hollow core member, a grip handle, grooves, and incremental weight members, that saves space, equipment, and costs and facilitates safe usage thereof and additional strength training exercises. The core member is free of top and bottom spherical caps and defines a cavity therewithin, between top and bottom ends of the core member, for accommodating a user's hand and movements therewithin. The grip handle is disposed centrally inside the cavity along a horizontal axis transverse to a central axis of the core member. The grip handle distributes weight of the apparatus evenly around the hand gripping the grip handle. The core grooves are disposed at the top and bottom ends of the core member. The weight members are engaged with the core grooves at the top and bottom ends of the core member, without disrupting weight distribution of the grip handle.

19 Claims, 29 Drawing Sheets

ADJUSTABLE CENTER MASS WEIGHT APPARATUS

BACKGROUND

Strength training, also referred to as resistance training or weight training, comprises physical exercises that cause muscles to contract against an external resistance, for example, weights, for strengthening and toning muscles, tendons, ligaments, etc., and improving fitness of a user. A user may undergo strength training, for example, by lifting weights in different forms such as medicine balls, resistance bands, weight machines, barbells, dumbbells, kettlebells, etc.

In a conventional dumbbell that comprises a handle for holding weights that are connected to opposing ends of the handle, the distribution of the weights is on two sides of the handle being gripped by a user. Heavy dumbbells create limitations because of the size of the weights relative to the center of the handle. A kettlebell comprises a cast iron or cast steel ball with a handle attached to the top of the ball. The weight, that is, the ball, of the kettlebell hangs from one end of the handle. Weight distribution on two sides of a gripped handle as with the dumbbell, or a weight hanging from one end of the gripped handle as with the kettlebell, makes utilizing these weights difficult and dangerous.

In some conventional dumbbells, the weights are affixed to the handles using threaded bolts. If the threaded bolts holding the weights in place on a dumbbell becomes loose, the risk of injury is significantly increased if one of the weights moves or falls off of the handle. Using conventional dumbbells with circular weights or plates for a strength training exercise creates an additional challenge of precluding the circular weights from rolling off the handle. Similar to a kettlebell, a center mass bell comprises one solid piece of metal free of bolts that can come lose or plates that can fall off. A center mass bell comprises a handle that is inside of its main body, where weight is evenly distributed all the way around a user's hand gripping the handle, which makes the center mass bell safe and more effective for strength training exercises. The center mass bell provides substantial versatility as the handle is positioned directly in the center of the mass. Moreover, because the user's hand is completely enclosed by the center mass bell, there is no risk of having fingers pinched or smashed when placing the weights back on a rack at the end of a fatiguing set.

In most commercial and team strength training facilities that utilize conventional weights, dumbbells, kettlebells, or center mass bells take up a substantial amount of space and cost a substantial amount of money among all the equipment in these facilities. In home gym settings, most people do not have the space to own multiple sets of any of these weights. For example, a full set of center mass bells typically comprises about 30 pieces of expensive equipment, the storage of which requires a substantial amount of space. There is a need for adjustable versions of a weight apparatus for creating a safe training and storage environment with cost savings and without the clutter of multiple pieces of equipment.

Hence, there is a long-felt need for an adjustable center mass weight apparatus that allows incremental weights to be added on a single apparatus without disrupting weight distribution of the handle of the apparatus, in addition to saving space, equipment, and costs and facilitating safe usage thereof. Furthermore, there is a need for an adjustable center mass weight apparatus that can be converted into another weight apparatus for facilitating additional strength training exercises.

SUMMARY OF THE INVENTION

This summary is provided to introduce a selection of concepts in a simplified form that are further disclosed in the detailed description of the invention. This summary is not intended to determine the scope of the claimed subject matter.

The apparatus disclosed herein addresses the above-recited need for an adjustable center mass weight apparatus that allows incremental weights to be added on a single apparatus without disrupting weight distribution of a handle of the apparatus, in addition to saving space, equipment, and costs and facilitating safe usage thereof. Furthermore, the apparatus disclosed herein addresses the above-recited need for an adjustable center mass weight apparatus that can be converted into another weight apparatus for facilitating additional strength training exercises. Similar to a center mass bell, weight of the grip handle of the adjustable center mass weight apparatus is centered inside of the total weight distribution. The incremental or add-on weight members with increments of, for example, about 5 pounds (lbs), can be added to a top end and a bottom end of a core member of the adjustable center mass weight apparatus. Moreover, the top end and the bottom end of the core member are milled with grooves, making it possible to increase the weight that a user can hold in each hand, for example, by about 5 lbs to about 20 lbs. The grooves configured at the top end and the bottom end of the core member are herein referred to as "core grooves". The adjustable center mass weight apparatus allows a standard 20-lb center mass bell to become a 25-lb, 30-lb, 35-lb, or 40-lb weight with the addition of one of the screw-on, incremental weight members. The incremental weight members increase the weight of the adjustable center mass weight apparatus without disrupting the weight distribution of the grip handle.

The adjustable center mass weight apparatus disclosed herein comprises a generally spherical, hollow core member, a grip handle, multiple core grooves, and multiple incremental weight members. The generally spherical, hollow core member, hereinafter referred to as a core member, is free of a top spherical cap and a bottom spherical cap. The core member defines a cavity therewithin, between a top end and a bottom end of the core member. The cavity is configured to accommodate a hand of a user and movements of the user's hand therewithin. The grip handle is disposed centrally inside the cavity of the core member, along a horizontal axis transverse to a central axis of the core member. A cross-section of the grip handle is, for example, a circular cross-section, an oblong cross-section, or an ovoid cross-section. The grip handle is configured to be gripped by the user's hand and to distribute weight of the adjustable center mass weight apparatus evenly around the user's hand.

The core grooves are disposed at the top end and the bottom end of the core member. In another embodiment, the top end of the core member comprises an opening extending inwardly from the top end of the core member into the cavity of the core member, and the bottom end of the core member comprises another opening extending inwardly from the bottom end of the core member. In this embodiment, the core grooves comprise inner grooves configured on both the inwardly extending openings of the core member.

The incremental weight members are configured to engage with the core grooves at the top end and the bottom end of the core member, without disrupting weight distribution of the grip handle. In an embodiment, the incremental weight members comprise a top weight member and a bottom weight member. The top weight member is configured to engage with the core grooves at the top end of the core member. In an embodiment, the top weight member is a generally spherical cap comprising an opening and weight grooves. Grooves milled at a bottom end of the top weight member are herein referred to as "weight grooves". The opening is configured at a top end of the top weight member and is configured to be in fluid communication with the cavity of the core member. The opening of the top weight member is configured to accommodate the hand and a wrist of the user and the movements of the hand and the wrist within the cavity of the core member. The weight grooves are configured on a protruding section extending outwardly from the bottom end of the top weight member. The weight grooves of the top weight member are configured to engage with the core grooves at the top end of the core member to attach the top weight member to the top end of the core member.

The bottom weight member is configured to engage with the core grooves at the bottom end of the core member. In an embodiment, the bottom weight member is a generally spherical cap comprising weight grooves configured on a protruding section extending outwardly in an upward direction from a top end of the bottom weight member. Grooves milled at the top end of the bottom weight member are herein also referred to as "weight grooves". The weight grooves of the bottom weight member are configured to engage with the core grooves at the bottom end of the core member to attach the bottom weight member to the bottom end of the core member.

In an embodiment, the incremental weight members comprise a top handle attachment and a bottom weight member. The bottom weight member is configured to engage with the core grooves at the bottom end of the core member as disclosed above. The top handle attachment is configured to convert the adjustable center mass weight apparatus into another weight apparatus, for example, a kettlebell, for facilitating additional strength training exercises, for example, swings, carries, etc. In an embodiment, the top handle attachment comprises a grip handle, a support member, and a protruding section. The grip handle of the top handle attachment is attached to and extends upwardly from a top end of the support member. The protruding section of the top handle attachment extends outwardly from a bottom end of the support member. In an embodiment, the top handle attachment further comprises handle grooves configured on the protruding section of the top handle attachment. Grooves configured on the protruding section of the top handle attachment are herein referred to as "handle grooves". The handle grooves of the top handle attachment are configured to engage with the core grooves at the top end of the core member to attach the top handle attachment to the top end of the core member.

In another embodiment, the top handle attachment comprises a ring element, a support member, and a protruding section. The ring element is attached to and extends upwardly from a top end of the support member and comprises an opening configured to receive a training accessory, for example, a leather strap accessory, a rope accessory, etc. The protruding section extends outwardly from a bottom end of the support member and comprises handle grooves configured to engage with the core grooves at the top end of the core member to attach the top handle attachment to the top end of the core member.

Disclosed herein is also a method for using the adjustable center mass weight apparatus above. In the method disclosed herein, the adjustable center mass weight apparatus is assembled by attaching the bottom weight member to the bottom end of the core member, and attaching the top weight member or the top handle attachment to the top end of the core member. The top handle attachment converts the adjustable center mass weight apparatus into another weight apparatus, for example, a kettlebell. The bottom weight member is attached to the bottom end of the core member by engaging the core grooves at the bottom end of the core member with corresponding weight grooves of the bottom weight member. The top weight member or the top handle attachment is attached to the top end of the core member by engaging the core grooves at the top end of the core member with corresponding grooves of the top weight member or the top handle attachment. The grip handle or the top handle attachment of the assembled, adjustable center mass weight apparatus is then gripped by a user's hand. To grip the grip handle disposed centrally inside the cavity of the core member of the assembled, adjustable center mass weight apparatus, the user inserts a hand into the cavity of the core member and grasps the grip handle. The grip handle is configured to distribute weight of the adjustable center mass weight apparatus evenly around the user's hand. To grip the top handle attachment of the assembled, adjustable center mass weight apparatus, the user grasps the upwardly extending grip handle of the top handle attachment. The user then maneuvers the adjustable center mass weight apparatus through the gripped grip handle or the top handle attachment during one or more of multiple exercises, for example, bench presses, overhead presses, swings, rows, lunges, squats, twists, etc.

BRIEF DESCRIPTION OF THE DRAWINGS

The foregoing summary, as well as the following detailed description of the invention, is better understood when read in conjunction with the appended drawings. For illustrating the embodiments herein, exemplary constructions of the embodiments are shown in the drawings. However, the embodiments herein are not limited to the specific components, structures, and methods disclosed herein. The description of a component, or a structure, or a method step referenced by a numeral in a drawing is applicable to the description of that component, or structure, or method step shown by that same numeral in any subsequent drawing herein. The terms "top", "bottom", "front", "rear", "side", "inner", "outer", "horizonal", "central", "upward", "downward", etc., are based on an orientation or a positional relationship shown in the appended drawings, and are recited merely for describing the embodiments herein, rather than indicating or implying that the device, component, or structure referenced must have a particular orientation or position or must be constructed and operated in a particular orientation, and therefore should not be construed as limiting the embodiments herein.

DETAILED DESCRIPTION OF THE INVENTION

Figure 1A:
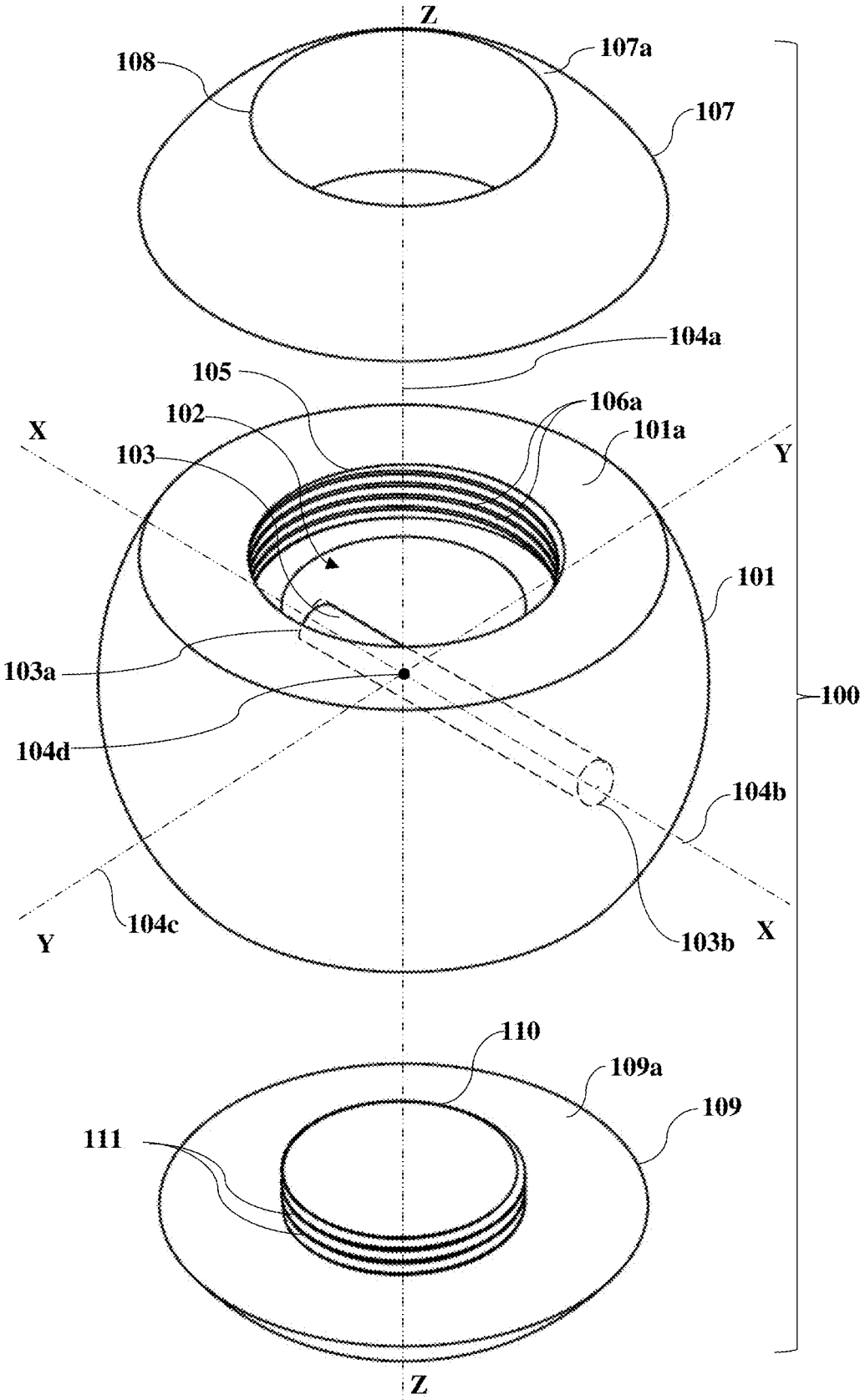
FIG. 1A illustrates an exploded, top perspective view of an embodiment of an adjustable center mass weight apparatus.
Figure 1B:
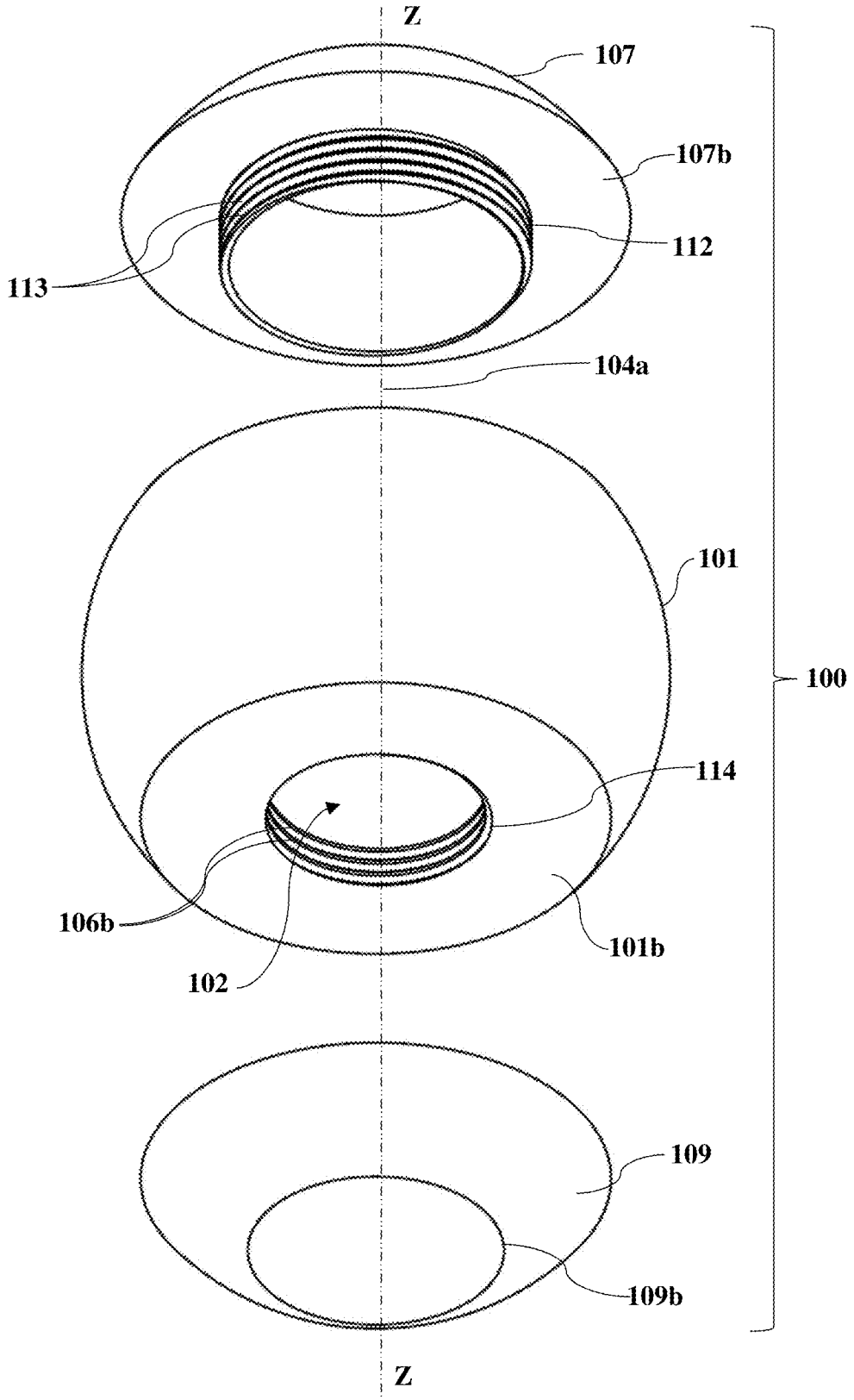
FIGS. 1B-1C illustrate exploded, bottom perspective views of the embodiment of the adjustable center mass weight apparatus shown in FIG. 1A.
Figure 1C:
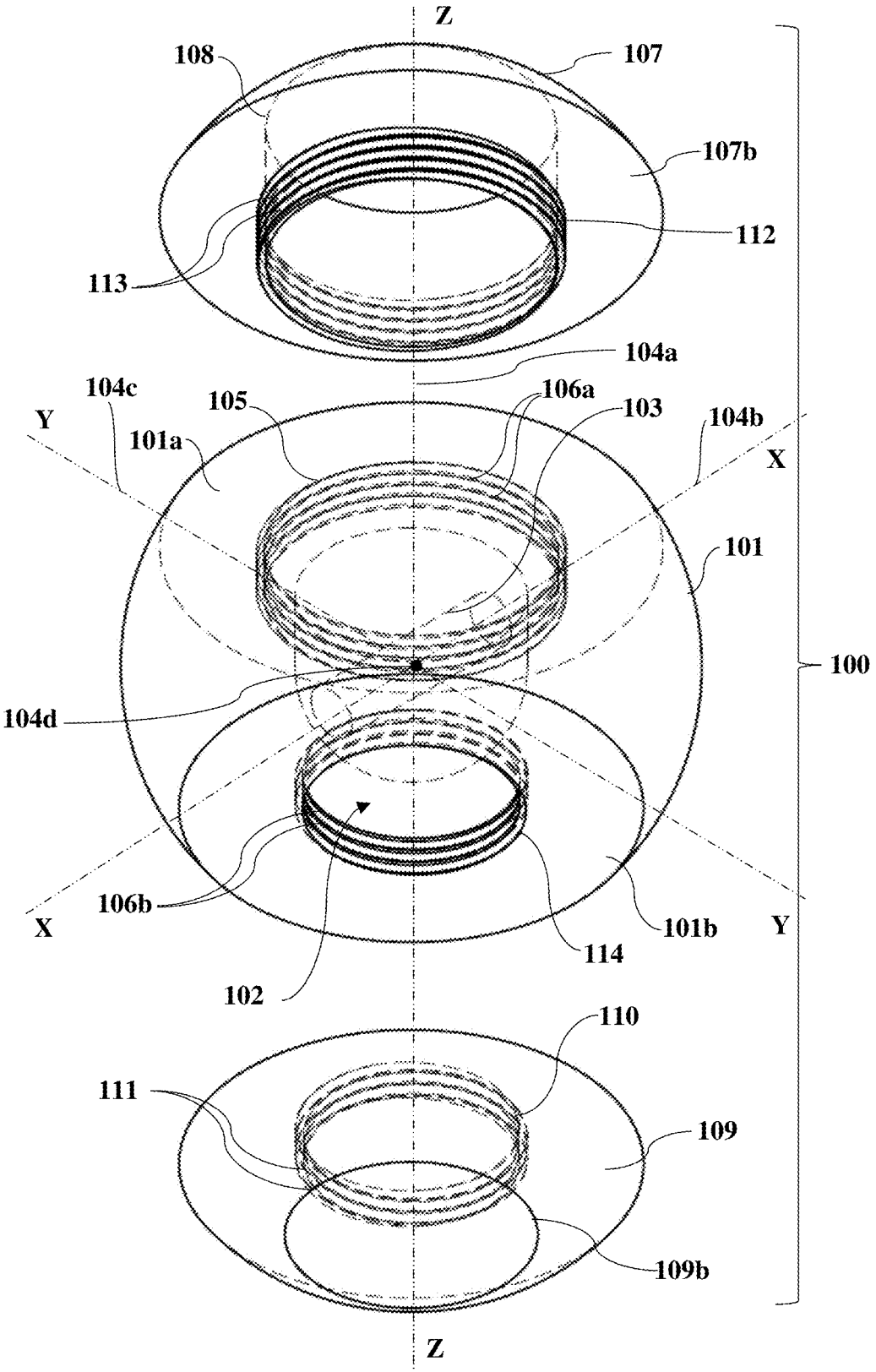

FIG. 1A and FIGS. 1B-1C illustrate an exploded, top perspective view and exploded, bottom perspective views of an embodiment of an adjustable center mass weight apparatus 100, respectively. The adjustable center mass weight apparatus 100 disclosed herein comprises a generally spherical, hollow core member 101, a grip handle 103, core grooves 106*a* and 106*b*, and multiple incremental weight members 107 and 109. The generally spherical, hollow core member 101, hereinafter referred to as a core member 101, is free of a top spherical cap and a bottom spherical cap. The core member 101 defines a cavity 102 therewithin, between a top end 101*a* and a bottom end 101*b* of the core member 101. The cavity 102 is configured to accommodate a hand of a user and movements of the user's hand therewithin.

The grip handle 103 is disposed centrally inside the cavity 102 of the core member 101, along a horizontal axis X-X 104*b* transverse to a central axis Z-Z 104*a* of the core member 101. Opposing ends 103*a* and 103*b* of the grip handle 103 are internally and centrally molded to an interior wall of the core member 101 within the cavity 102 of the core member 101 as illustrated in FIG. 1A, by different injection molding and/or casting technologies, for example, cast iron molding. The distance of the grip handle 103 from each of the top end 101*a* and the bottom end 101*b* of the core member 101 is, for example, about 4 inches. The grip handle 103 is configured to be gripped by the user's hand and to distribute weight of the adjustable center mass weight apparatus 100 evenly around the user's hand. In an embodiment, a cross-section of the grip handle 103 is a circular cross-section as illustrated in FIG. 1A and FIG. 3F. In another embodiment, the cross-section of the grip handle 103 is, for example, an oblong cross-section or an ovoid cross-section.

The core grooves 106*a* and 106*b* are disposed at the top end 101*a* and the bottom end 101*b* of the core member 101 as illustrated in FIG. 1A and FIGS. 1B-1C, respectively. In an embodiment, the top end 101*a* of the core member 101 comprises an opening 105 extending inwardly from the top end 101*a* of the core member 101 into the cavity 102 of the core member 101 as illustrated in FIG. 1A. In the embodiment illustrated in FIGS. 1B-1C, the bottom end 101*b* of the core member 101 comprises an opening 114 extending inwardly from the bottom end 101*b* of the core member 101 into the cavity 102 of the core member 101. In an embodiment, the core grooves comprise inner grooves 106*a* and 106*b*. The inner grooves 106*a* are, for example, internal screw threads, configured on the inwardly extending openings 105 and 114 of the core member 101.

The incremental weight members 107 and 109 are configured to screwably engage with the core grooves 106*a* and 106*b* at the top end 101*a* and the bottom end 101*b* of the core member 101, respectively, without disrupting weight distribution of the grip handle 103. In an embodiment as illustrated in FIGS. 1A-1C, the incremental weight members comprise a top weight member 107 and a bottom weight member 109. The top weight member 107 is configured to engage with the core grooves 106*a* at the top end 101*a* of the core member 101. In an embodiment, the top weight member 107 is a generally spherical cap comprising an opening 108 as illustrated in FIG. 1A, and weight grooves 113 as illustrated in FIGS. 1B-1C. The opening 108 is configured at the top end 107*a* of the top weight member 107 and is configured to be in fluid communication with the cavity 102 of the core member 101. The opening 108 of the top weight member 107 is configured to accommodate the hand and a wrist of the user and the movements of the hand and the wrist within the cavity 102 of the core member 101. A user inserts a hand into the cavity 102 of the core member 101 via the opening 108 of the top weight member 107 to grasp the grip handle 103. In an embodiment, the structure and dimensions of the opening 108 of the top weight member 107 allow for minimal to no contact between the user's hand and/or wrist and the top weight member 107. In another embodiment, the opening 108 of the top weight member 107 is configured with a rounded and smooth inner edge to provide comfort to the user's inserted hand. In another embodiment, the opening 108 of the top weight member 107 is configured with a rounded beveled edge to provide comfort to the user's inserted hand. In an embodiment, the weight grooves 113 are configured on the protruding section 112 extending outwardly in a downward direction from the bottom end 107*b* of the top weight member 107 as illustrated in FIGS. 1B-1C. The weight grooves 113 of the top weight member 107 are configured to engage with the core grooves 106*a* at the top end 101*a* of the core member 101 to attach the top weight member 107 to the top end 101*a* of the core member 101.

The bottom weight member 109 is configured to engage with the core grooves 106*b* at the bottom end 101*b* of the core member 101. In an embodiment, the bottom weight member 109 is a generally spherical cap comprising weight grooves 111 configured on a protruding section 110 extending outwardly in an upward direction from the top end 109*a* of the bottom weight member 109 as illustrated in FIG. 1A. The weight grooves 111 of the bottom weight member 109 are configured to engage with the core grooves 106*b* at the bottom end 101*b* of the core member 101 to attach the bottom weight member 109 to the bottom end 101*b* of the core member 101.

In an embodiment, the incremental weight members 107 and 109 are engaged to the core member 101 in such a way as to substantially balance the weight of the adjustable center mass weight apparatus 100 along at least three axes X-X 104*b*, Y-Y 104*c*, and Z-Z 104*a* such that the weight is the same in all directions from a center point 104*d* to the outer circumference of the adjustable center mass weight apparatus 100. That is, the weight distribution is the same in the three axes X-X 104*b*, Y-Y 104*c*, and Z-Z 104*a* from the center point 104*d* of the adjustable center mass weight apparatus 100. In an example, the overall weight of the adjustable center mass weight apparatus 100 ranges from about 20 pounds to about 120 pounds.

Figure 2A:
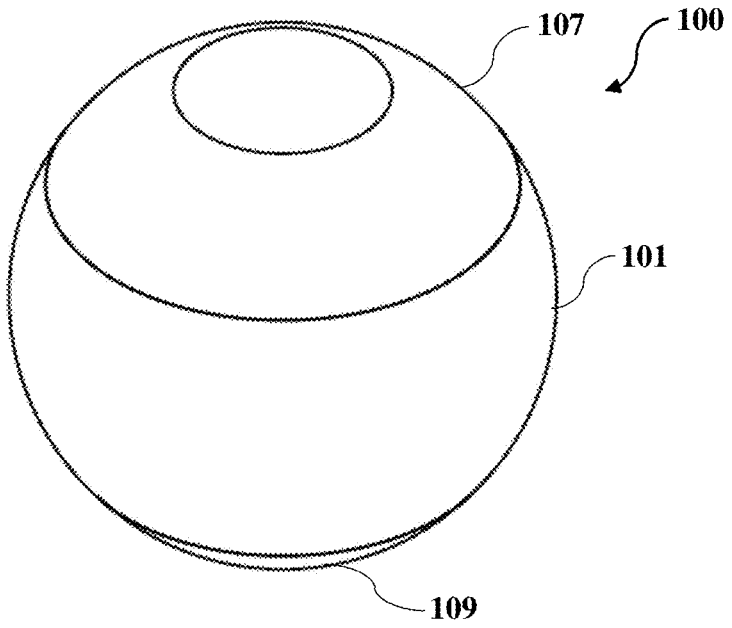
FIG. 2A illustrates a top perspective view of the assembled adjustable center mass weight apparatus shown in FIGS. 1A-1B.

FIG. 2A illustrates a top perspective view of the assembled adjustable center mass weight apparatus 100 shown in FIGS. 1A-1B. In an embodiment, the adjustable center mass weight apparatus 100 is assembled by engaging the top weight member 107 and the bottom weight member 109 to the top end 101*a* and the bottom end 101*b* of the core member 101, respectively, as illustrated in FIG. 2A. The adjustable center mass weight apparatus 100 is made, for example, of cast iron, steel, etc. In an embodiment, the adjustable center mass weight apparatus 100 is made of cast iron to provide required weight to the adjustable center mass weight apparatus 100.

Figure 2B:
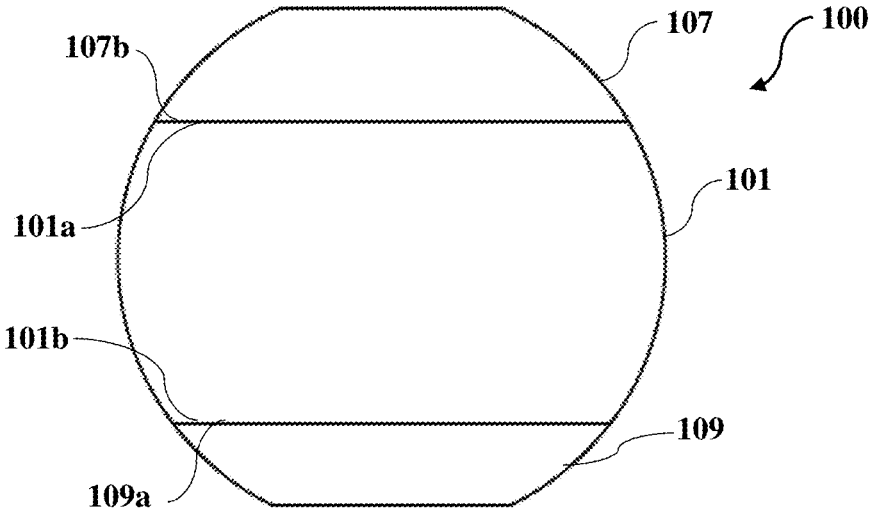
FIG. 2B illustrates a front elevation view of the adjustable center mass weight apparatus shown in FIG. 2A, the rear elevation view, the right-side elevation view, and the left-side elevation view being mirror images thereof.

FIG. 2B illustrates a front elevation view of the adjustable center mass weight apparatus 100 shown in FIG. 2A, the rear elevation view, the right-side elevation view, and the left-side elevation view being mirror images thereof. When the top weight member 107 is engaged to the top end 101*a* of the core member 101, the bottom end 107*b* of the top weight member 107 lies flush against the top end 101*a* of the core member 101. Similarly, when the bottom weight member 109 is engaged to the bottom end 101*b* of the core member 101, the top end 109*a* of the bottom weight member 109 lies flush against the bottom end 101*b* of the core member 101. In an embodiment as illustrated in FIG. 2B, the top end 107*a* of the top weight member 107 and the bottom end 109*b* of the bottom weight member 109 provide flat surfaces for firm and convenient storage of the adjustable center mass weight apparatus 100 on another flat surface. The adjustable center mass weight apparatus 100 may be stored by placing either the top end 107*a* of the top weight member 107 or the bottom end 109*b* of the bottom weight member 109 on another flat surface.

Figure 2C:
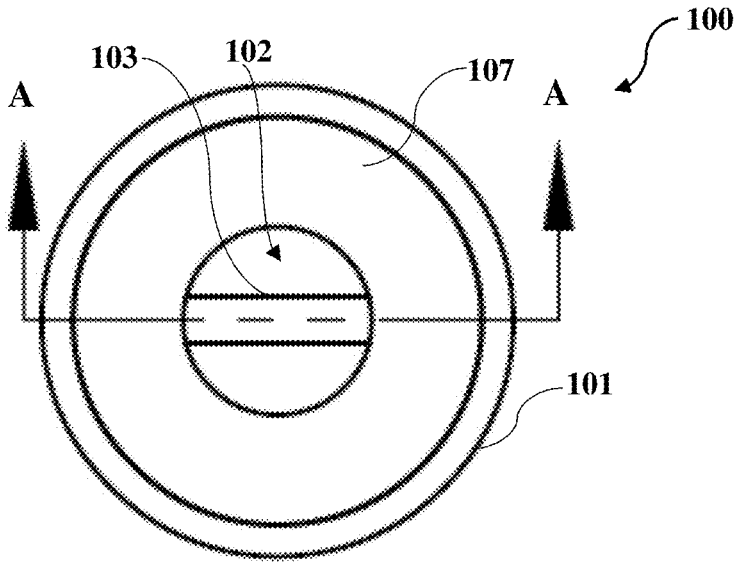
FIG. 2C illustrates a top plan view of the embodiment of the adjustable center mass weight apparatus shown in FIG. 2A.

FIG. 2C illustrates a top plan view of the embodiment of the adjustable center mass weight apparatus 100 shown in FIG. 2A. The top plan view in FIG. 2C illustrates the grip handle 103 disposed centrally inside the cavity 102 of the core member 101.

Figure 2D:
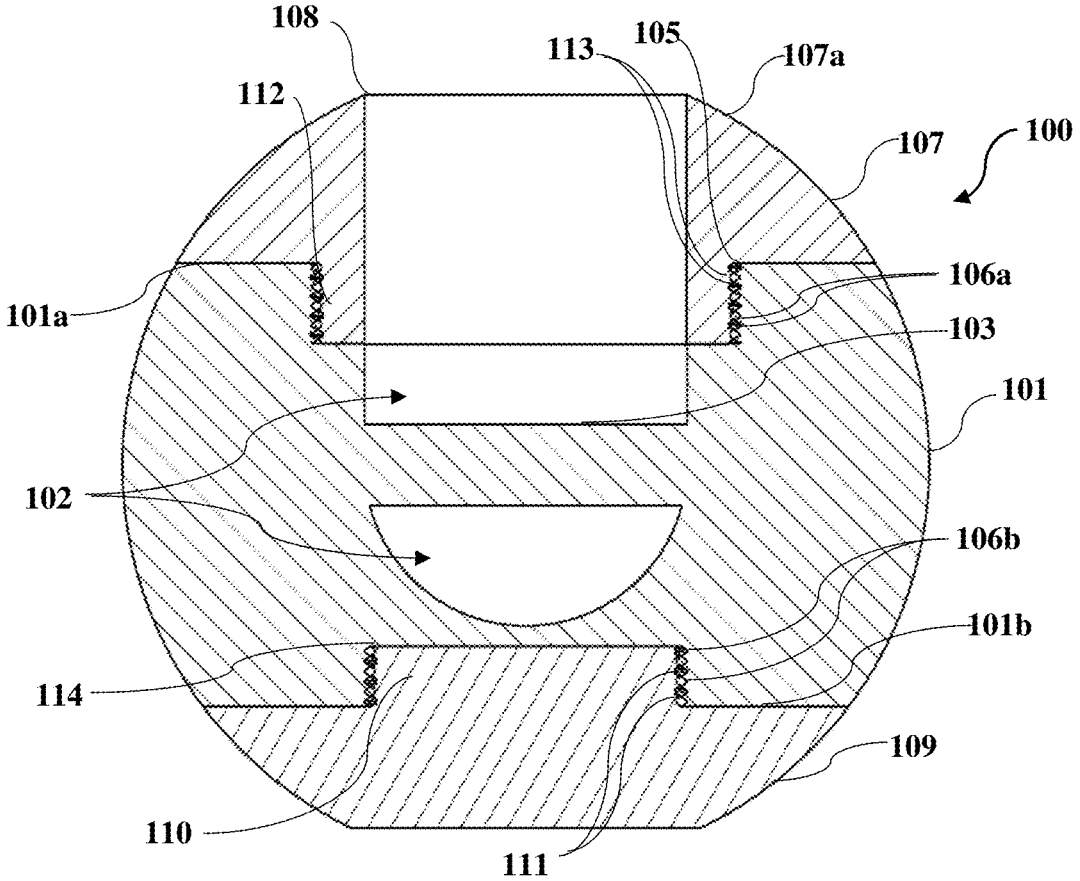
FIG. 2D illustrates a cross-sectional view of the adjustable center mass weight apparatus, taken along a sectional line A-A shown in FIG. 2C.

FIG. 2D illustrates a cross-sectional view of the adjustable center mass weight apparatus 100, taken along a sectional line A-A shown in FIG. 2C. The cross-sectional view in FIG. 2D illustrates the engagement of the top weight member 107 and the bottom weight member 109 to the top end 101*a* and the bottom end 101*b* of the core member 101, respectively. The top weight member 107 and the bottom weight member 109 are screwed onto the top end 101*a* and the bottom end 101*b* of the core member 101, respectively. When the top weight member 107 is screwed onto the top end 101*a* of the core member 101, the weight grooves 113, for example, external screw threads, configured on the protruding section 112 of the top weight member 107, engage with the core grooves 106*a*, for example, internal screw threads, configured in the opening 105 at the top end 101*a* of the core member 101 illustrated in FIG. 1A, to attach the top weight member 107 to the top end 101*a* of the core member 101. When the bottom weight member 109 is screwed onto the bottom end 101*b* of the core member 101, the weight grooves 111, for example, external screw threads, configured on the protruding section 110 of the bottom weight member 109, engage with the core grooves 106*b*, for example, internal screw threads, configured in the opening 114 of the core member 101 illustrated in FIGS. 1B-1C, to attach the bottom weight member 109 to the bottom end 101*b* of the core member 101. The cross-sectional view in FIG. 2D also illustrates the opening 108 at the top end 107*a* of the top weight member 107 in fluid communication with the cavity 102 of the core member 101, when the top weight member 107 is attached to the top end 101*a* of the core member 101.

In an example, the adjustable center mass weight apparatus 100 allows a 20-lb core member 101 to become a 25-lb, 30-lb, 35-lb, or 40-lb weight with the addition of the top weight member 107 and/or the bottom weight member 109. The adjustable center mass weight apparatus 100 has an optimal geometric shape for maximizing optimal performance as a user's hand and the adjustable center mass weight apparatus 100 act as one. The adjustable center mass weight apparatus 100 changes the reaction of the user's involved muscles and connective tissues, allowing trainers and strength coaches to be more creative with incremental weights and multiplanar movement patterns used in workout programs. The optimal geometric shape of the adjustable center mass weight apparatus 100 allows users to improve the efficiency and balance of every swing and press while also reducing common safety risks of conventional weight apparatuses.

Figure 3A:
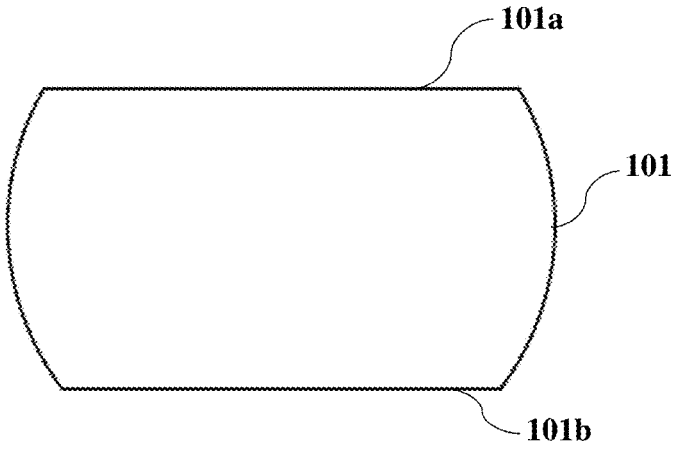
FIG. 3A illustrates a front elevation view of a core member of the embodiment of the adjustable center mass weight apparatus shown in FIGS. 2A-2D, the rear elevation view, the right-side elevation view, and the left-side elevation view being mirror images thereof.

FIG. 3A illustrates a front elevation view of the core member 101 of the embodiment of the adjustable center mass weight apparatus 100 shown in FIGS. 2A-2D, the rear elevation view, the right-side elevation view, and the left-side elevation view being mirror images thereof.

Figure 3B:
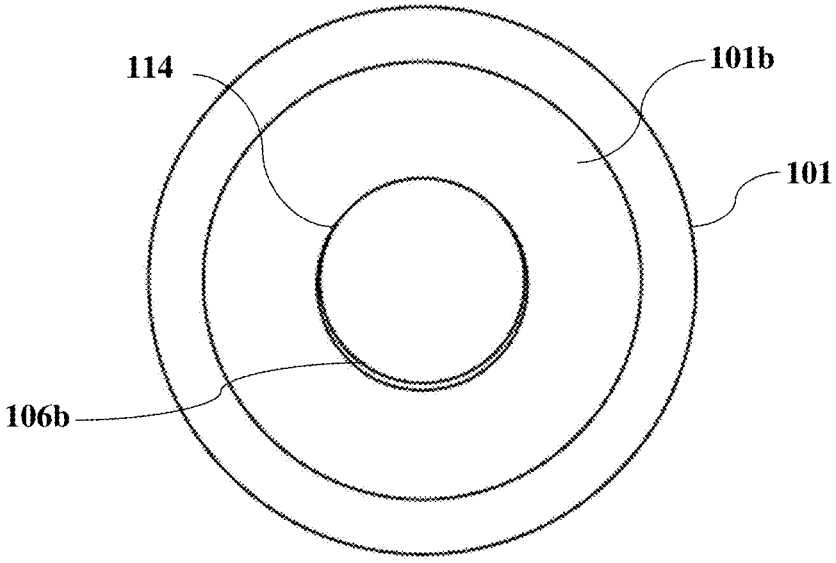
FIG. 3B illustrates a bottom elevation view of the core member shown in FIG. 3A.

FIG. 3B illustrates a bottom elevation view of the core member 101 shown in FIG. 3A. The bottom elevation view in FIG. 3B illustrates the opening 114 with the inner grooves 106*b* configured at the bottom end 101*b* of the core member 101.

Figure 3C:
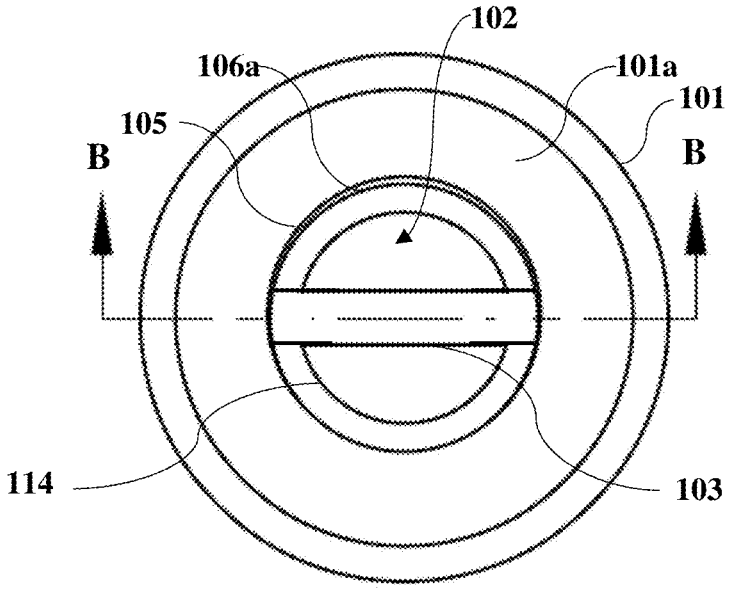
FIG. 3C illustrates a top plan view of the core member shown in FIG. 3A.

FIG. 3C illustrates a top plan view of the core member 101 shown in FIG. 3A. The top plan view in FIG. 3C illustrates the grip handle 103 disposed centrally inside the cavity 102 of the core member 101. The grip handle 103 of the adjustable center mass weight apparatus 100 is positioned in the exact center of the core member 101, thereby creating an enhanced stimulus and weight-lifting experience over a conventional dumbbell or a kettlebell. The grip handle 103 of the adjustable center mass weight apparatus 100 allows a user to place a hand directly in the center of the core member 101, which provides a comfortable distribution of weight around the user's hand and allows the weight of the adjustable center mass weight apparatus 100 to become a part of the user's body and to be moved in all directions, without weight transfer or shifting. The placement of the grip handle 103 in the center of the core member 101 allows users to change how they hold a weight, which can lead to a greater application of resistive force directly on the involved muscles of the users. Furthermore, the grip handle 103 allows a user to maintain a more comfortable hand position with a neutral wrist, thereby assisting the user in having an improved control of their movement during an exercise. When the user's hand holds the grip handle 103 inside the cavity 102 of the core member 101, every infinitesimal point on the surface of the adjustable center mass weight apparatus 100 is at an equal distance to the center of the user's hand. This dynamic reduces the shearing force on the user's joints and adds more load distribution on the user's muscles and connective tissues. In an example, the dimensions of the grip handle 103 comprise: a length ranging from about 4 inches to about 6.5 inches and a diameter ranging from about 1.46 inches to about 1.57 inches. The top plan view in FIG. 3C also illustrates the opening 105 with the inner grooves 106*a* defined at the top end 101*a* of the core member 101. In an example, a diameter of the opening 105 of the core member 101 is from about 5 inches to about 6 inches.

Figure 3D:
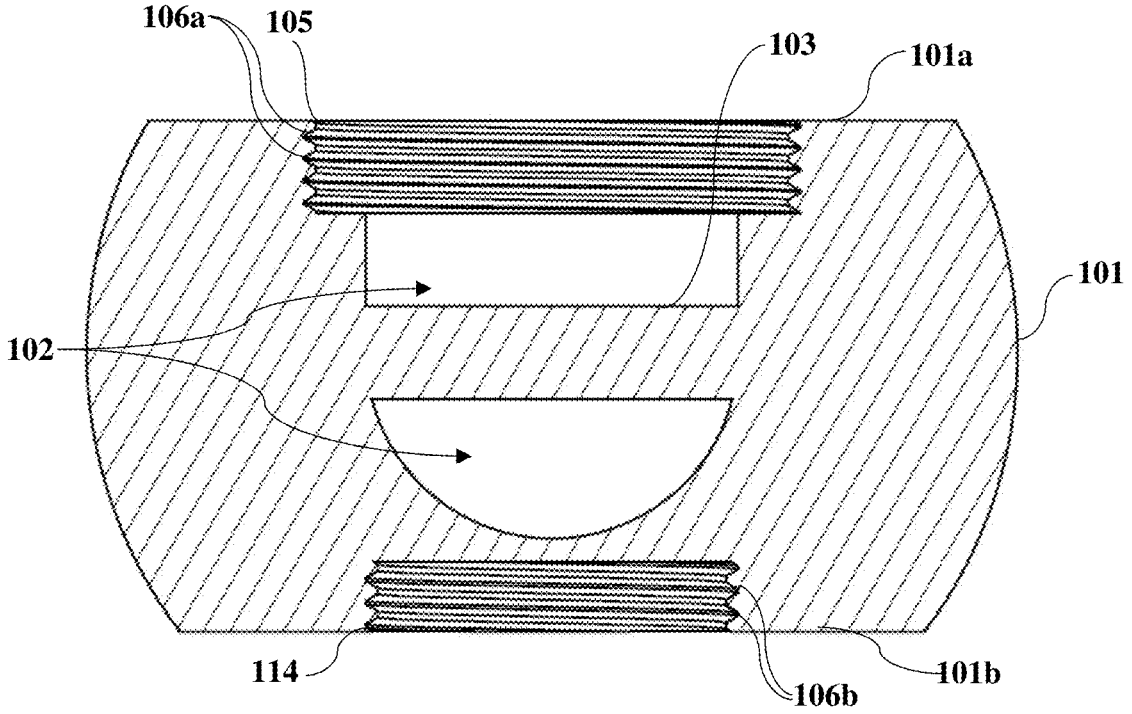
FIG. 3D illustrates a cross-sectional view of the core member, taken along a sectional line B-B shown in FIG. 3C.

FIG. 3D illustrates a cross-sectional view of the core member 101, taken along a sectional line B-B shown in FIG. 3C. The cross-sectional view in FIG. 3D illustrates the core grooves 106*a*, that is, the inner grooves, configured on the inwardly extending opening 105 at the top end 101*a* of the core member 101. In an example, the height of the cavity 102 of the core member 101 is from about 3 inches to about 6 inches. The cross-sectional view in FIG. 3D also illustrates the core grooves 106*b*, that is, the inner grooves, configured on the inwardly extending opening 114 at the bottom end 101*b* of the core member 101. In an example, the height to which the core grooves 106*a* of the core member 101 extend into the cavity 102 is from about 1 inch to about 1.5 inches from the top end 101*a* of the core member 101. Also, in an example, the height to which the core grooves 106*b* of the core member 101 extend into the cavity 102 is from about 1 inch to about 1.5 inches from the bottom end 101*b* of the core member 101. Furthermore, the cross-sectional view in FIG. 3D illustrates the grip handle 103 disposed centrally inside the cavity 102 of the core member 101.

Figure 3E:
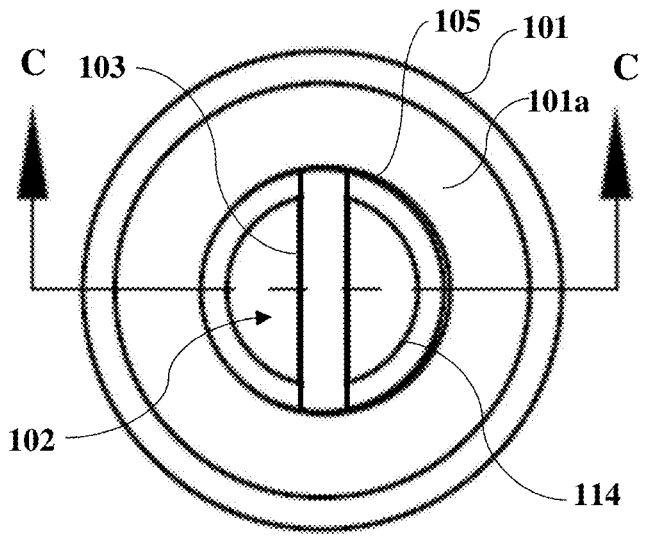
FIG. 3E illustrates another top plan view of the core member shown in FIG. 3A.
Figure 3F:
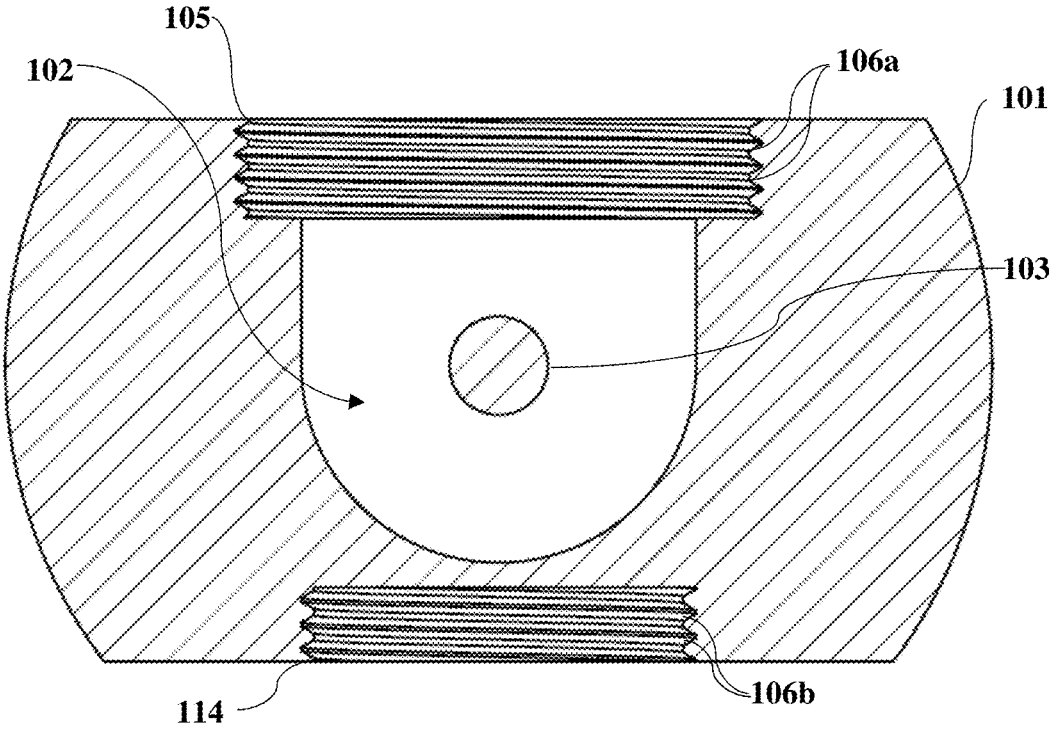
FIG. 3F illustrates a cross-sectional view of the core member, taken along a sectional line C-C shown in FIG. 3E.

FIG. 3E illustrates another top plan view of the core member 101 shown in FIG. 3A. The top plan view in FIG. 3E illustrates the grip handle 103 disposed centrally inside the cavity 102 of the core member 101. The top plan view in FIG. 3E also illustrates the opening 105 defined at the top end 101*a* of the core member 101.

FIG. 3F illustrates a cross-sectional view of the core member 101, taken along a sectional line C-C shown in FIG. 3E. The cross-sectional view in FIG. 3F illustrates the grip handle 103 disposed centrally inside the cavity 102 of the core member 101. In an embodiment as illustrated in FIG. 3F, the cross-section of the grip handle 103 is a circular cross-section. The cross-sectional view in FIG. 3F also illustrates the core grooves 106*a* and 106*b* disposed at the top end 101*a* and the bottom end 101*b* of the core member 101, respectively.

In an example, the dimensions of the core member 101 comprise: an outer diameter ranging from about 7.64 inches to about 9.65 inches; a height ranging from about 7 inches to about 12 inches; and a weight ranging from about 20 pounds to about 90 pounds. In another example, the dimensions of the core member 101 comprise: an outer diameter ranging from about 7.48 inches to about 9.84 inches; a height ranging from about 8 inches to about 12 inches; and a weight ranging from about 20 pounds to about 120 pounds.

Figure 4A:
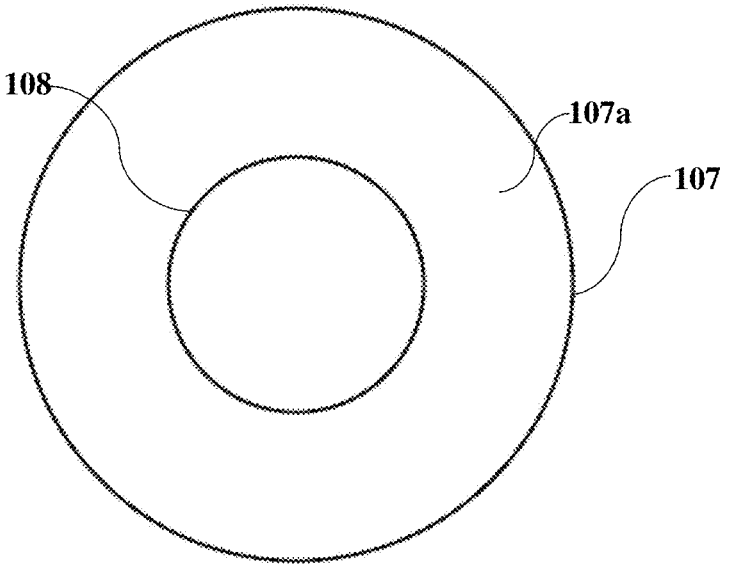
FIG. 4A illustrates a top plan view of a top weight member of the embodiment of the adjustable center mass weight apparatus shown in FIGS. 2A-2D.

FIG. 4A illustrates a top plan view of a top weight member 107 of the embodiment of the adjustable center mass weight apparatus 100 shown in FIGS. 2A-2D. The top plan view in FIG. 4A illustrates the opening 108 configured at the top end 107*a* of the top weight member 107. In an example, a diameter of the opening 108 of the top weight member 107 is from about 5 inches to about 8 inches. In another example, the diameter of the opening 108 of the top weight member 107 is from about 4 inches to about 6 inches. In an example, the dimensions of the top weight member 107 comprise: an outer diameter ranging from about 7 inches to about 8 inches; a height ranging from about 3 inches to about 4 inches; and a weight ranging from about 5 pounds to about 10 pounds. In another example, the dimensions of the top weight member 107 comprise: an outer diameter ranging from about 4 inches to about 6 inches; a height ranging from about 1.5 inches to about 2 inches; and a weight ranging from about 5 pounds to about 10 pounds.

Figure 4B:
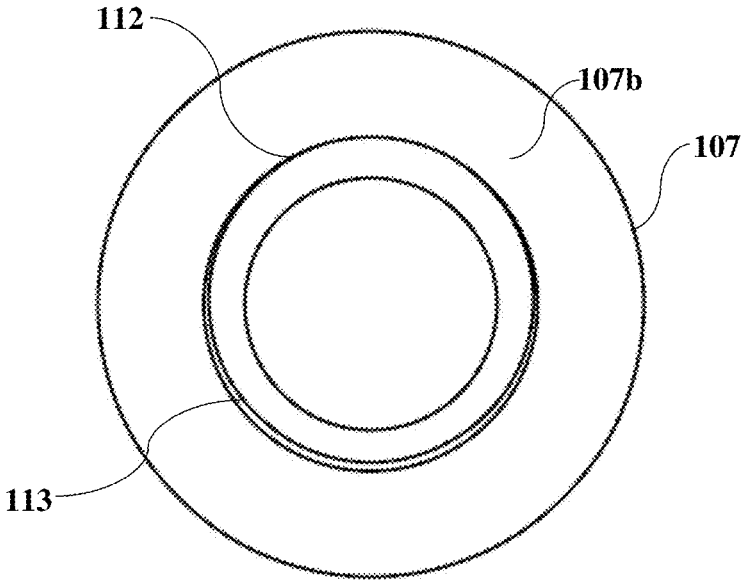
FIG. 4B illustrates a bottom elevation view of the top weight member shown in FIG. 4A.

FIG. 4B illustrates a bottom elevation view of the top weight member 107 shown in FIG. 4A. The bottom elevation view in FIG. 4B illustrates the protruding section 112 with the weight grooves 113 disposed at the bottom end 107*b* of the top weight member 107. In an example, the diameter of the protruding section 112 of the top weight member 107 is from about 4 inches to about 6 inches. Furthermore, in an example, the height of the protruding section 112 of the top weight member 107 is from about 0.5 inches to about 0.75 inches.

Figure 4C:
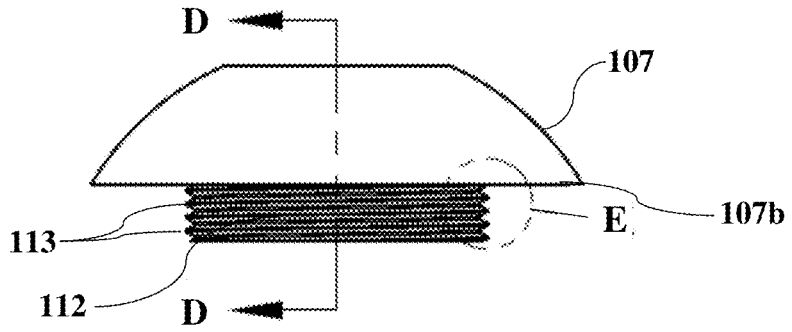
FIG. 4C illustrates a front elevation view of the top weight member shown in FIG. 4A, the rear elevation view, the right-side elevation view, and the left-side elevation view being mirror images thereof.

FIG. 4C illustrates a front elevation view of the top weight member 107 shown in FIG. 4A, the rear elevation view, the right-side elevation view, and the left-side elevation view being mirror images thereof. The front elevation view in FIG. 4C illustrates the protruding section 112 with the weight grooves 113 configured thereon, extending downwardly from the bottom end 107*b* of the top weight member 107.

Figure 4D:
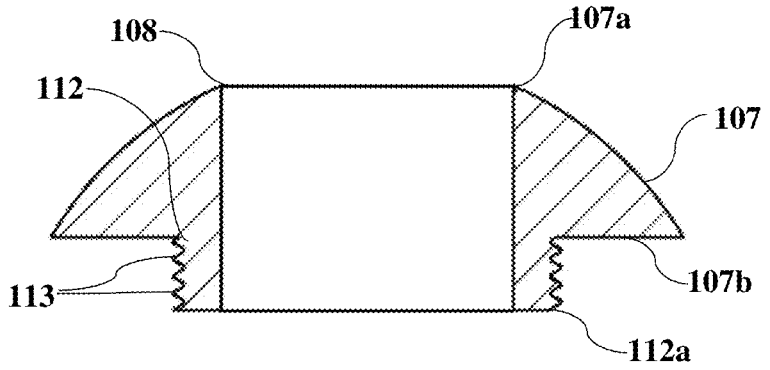
FIG. 4D illustrates a cross-sectional view of the top weight member, taken along a sectional line D-D shown in FIG. 4C.

FIG. 4D illustrates a cross-sectional view of the top weight member 107, taken along a sectional line D-D shown in FIG. 4C. The cross-sectional view in FIG. 4D illustrates the opening 108 of the top weight member 107, which extends from the top end 107*a* of the top weight member 107 to the bottom end 112*a* of the protruding section 112 of the top weight member 107. The opening 108 at the top end 107*a* of the top weight member 107 extends inwardly from the top end 107*a* of the top weight member 107 and is in fluid communication with the cavity 102 of the core member 101 when the top weight member 107 is attached to the top end 101*a* of the core member 101 as illustrated in FIG. 2D. In an example, the height of the opening 108 of the top weight member 107 is from about 2.5 inches to about 4 inches. In another example, the height of the opening 108 of the top weight member 107 is from about 2 inches to about 3 inches.

Figure 4E:
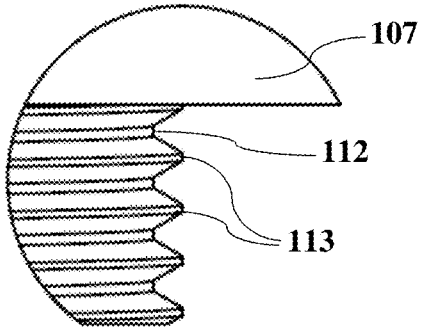
FIG. 4E illustrates an enlarged view of a portion marked E in FIG. 4C, showing weight grooves configured on a protruding section of the top weight member.

FIG. 4E illustrates an enlarged view of a portion marked E in FIG. 4C, showing weight grooves 113 configured on the protruding section 112 of the top weight member 107. In an embodiment, the weight grooves 113 of the top weight member 107 are outer grooves, for example, external screw threads, as illustrated in FIG. 4E.

Figure 5A:
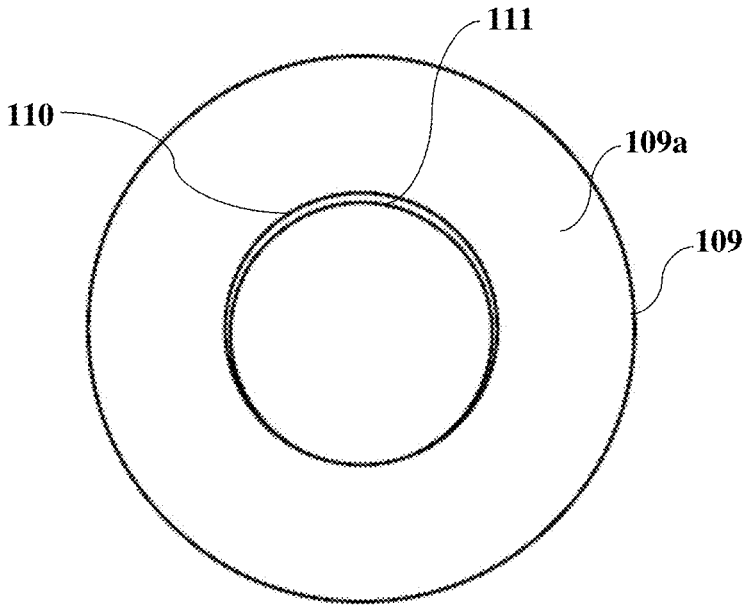
FIG. 5A illustrates a top plan view of a bottom weight member of the embodiment of the adjustable center mass weight apparatus shown in FIGS. 2A-2D.

FIG. 5A illustrates a top plan view of the bottom weight member 109 of the embodiment of the adjustable center mass weight apparatus 100 shown in FIGS. 2A-2D. The top plan view in FIG. 5A illustrates the protruding section 110 configured at the top end 109*a* of the bottom weight member 109. In an example, the diameter of the protruding section 110 of the bottom weight member 109 is from about 3 inches to about 4 inches. Furthermore, in an example, the height of the protruding section 110 of the bottom weight member 109 is from about 1 inch to about 1.5 inches. The weight grooves 111 are configured on the protruding section 110 that extends outwardly in an upward direction from the top end 109*a* of the bottom weight member 109. In an example, the dimensions of the bottom weight member 109 comprise: an outer diameter ranging from about 5.5 inches to about 7.5 inches; a height ranging from about 3 inches to about 4 inches; and a weight ranging from about 5 pounds to about 10 pounds. In another example, the dimensions of the bottom weight member 109 comprise: an outer diameter ranging from about 4 inches to about 8 inches; a height ranging from about 1.5 inches to about 3 inches; and a weight ranging from about 5 pounds to about 10 pounds. In another example, the dimensions of the bottom weight member 109 comprise: an outer diameter ranging from about 5 inches to about 8 inches; a height ranging from about 2 inches to about 3 inches; and a weight ranging from about 5 pounds to about 10 pounds.

Figure 5B:
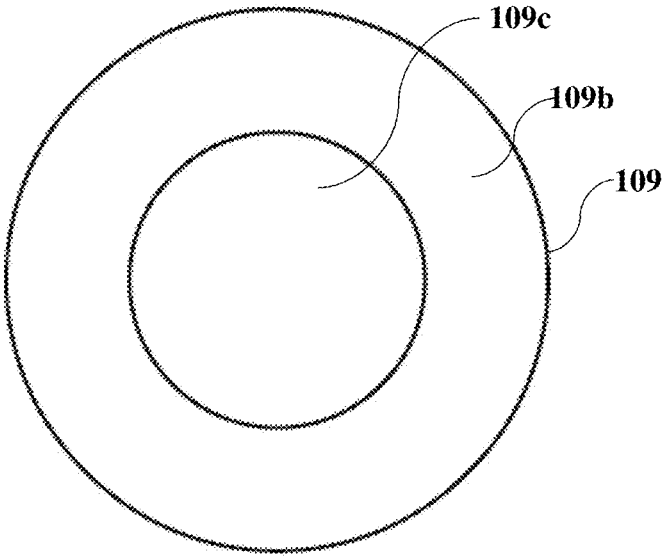
FIG. 5B illustrates a bottom elevation view of the bottom weight member shown in FIG. 5A.

FIG. 5B illustrates a bottom elevation view of the bottom weight member 109 shown in FIG. 5A. The bottom elevation view in FIG. 5B illustrates the closed bottom end 109*b* of the bottom weight member 109. The closed bottom end 109*b* of the bottom weight member 109 comprises a flat surface 109*c* that allows the adjustable center mass weight apparatus 100 shown in FIGS. 2A-2D, to be stored firmly and conveniently on another flat surface.

Figure 5C:
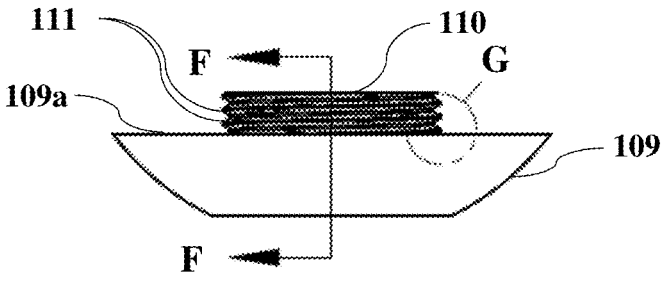
FIG. 5C illustrates a front elevation view of the bottom weight member shown in FIG. 5A, the rear elevation view, the right-side elevation view, and the left-side elevation view being mirror images thereof.
Figure 5D:
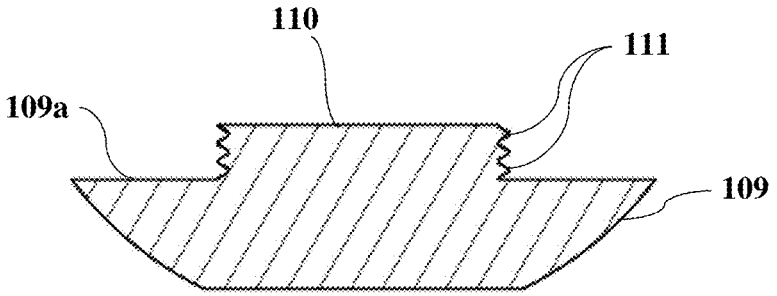
FIG. 5D illustrates a cross-sectional view of the bottom weight member, taken along a sectional line F-F shown in FIG. 5C.

FIG. 5C illustrates a front elevation view of the bottom weight member 109 shown in FIG. 5A, the rear elevation view, the right-side elevation view, and the left-side elevation view being mirror images thereof. FIG. 5D illustrates a cross-sectional view of the bottom weight member 109, taken along a sectional line F-F shown in FIG. 5C. The front elevation view in FIG. 5C and the cross-sectional view in FIG. 5D illustrate the weight grooves 111, that is, the outer grooves, configured on the protruding section 110 extending outwardly in an upward direction from the top end 109*a* of the bottom weight member 109. In an example, the height to which the weight grooves 111 of the bottom weight member 109 extend is from about 1.5 inches to about 2 inches.

Figure 5E:
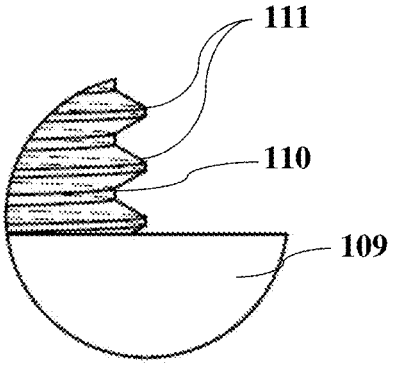
FIG. 5E illustrates an enlarged view of a portion marked G in FIG. 5C, showing weight grooves configured on a protruding section extending upwardly from a top end of the bottom weight member.

FIG. 5E illustrates an enlarged view of a portion marked G in FIG. 5C, showing weight grooves 111 configured on the protruding section 110 extending upwardly from the top end 109*a* of the bottom weight member 109. The weight grooves 111 are, for example, external screw threads, as illustrated in FIG. 5E.

In an prophetic embodiment (not shown), the adjustable center mass weight apparatus 100 comprises the top weight member 107 with an opening 108 and a protrusion section 112 as illustrated in FIGS. 1A-1C; a core member 101 comprising an opening 105 configured at the top end 101*a* of the core member 101 and a protrusion section (not shown) extending outwardly in a downward direction from the bottom end 101*b* of the core member 101; and a bottom weight member 109 comprising an opening configured at the top end 109*a* of the bottom weight member 109. Furthermore, in this embodiment, the bottom weight member 109 comprises a closed bottom end 109*b*. The top weight member 107 is attached to the top end 101*a* of the core member 101 by screwably engaging the protrusion section 112 of the top weight member 107 with the opening 105 at the top end 101*a* of the core member 101. The bottom weight member 109 is attached to the bottom end 101*b* of the core member 101 by screwably engaging the protrusion section at the bottom end 101*b* of the core member 101 with the opening at the top end 109*a* of the bottom weight member 109. When the top weight member 107 is attached to the top end 101*a* of the core member 101, the protrusion section 112 of the top weight member 107 is in fluid communication with the opening 105 and the cavity 102 of the core member 101. This embodiment of the adjustable center mass weight apparatus 100 allows a user's hand to access the grip handle 103 in the cavity 102 of the core member 101 from the top opening 108 at the top end 107*a* of the top weight member 107.

In another prophetic embodiment (not shown), the adjustable center mass weight apparatus 100 comprises a top weight member 107 with coaxial openings at the top end 107*a* and the bottom end 107*b* of the top weight member 107; a core member 101 comprising an open-ended protrusion section (not shown) extending outwardly in an upward direction from the top end 101*a* of the core member 101 and an opening configured on the bottom end 101*b* of the core member 101; and a bottom weight member 109 comprising a protrusion section 110 extending outwardly in an upward direction from the top end 109*a* of the bottom weight member 109 as illustrated in FIG. 1A, FIG. 2D, and FIGS. 5A-5E. In this embodiment, the opening at the bottom end 101*b* of the core member 101 is similar to the opening 114 of the core member 101 illustrated in FIGS. 1B-1C. In an embodiment, the protrusion section of the bottom weight member 109 is open-ended. In another embodiment, the protrusion section of the bottom weight member 109 is close-ended. Furthermore, in this embodiment, the bottom weight member 109 comprises a closed bottom end 109*b*. The top weight member 107 is attached to the top end 101*a* of the core member 101 by screwably engaging the open-ended protrusion section at the top end 101*a* of the core member 101 with the opening at the bottom end 107*b* of the top weight member 107. The bottom weight member 109 is attached to the bottom end 101*b* of the core member 101 by screwably engaging the protrusion section 110 of the bottom weight member 109 with the opening at the bottom end 101*b* of the core member 101. When the top weight member 107 is attached to the top end 101*a* of the core member 101, the coaxial openings of the top weight member 107 are in fluid communication with the open-ended protrusion section and the cavity 102 of the core member 101. This embodiment of the adjustable center mass weight apparatus 100 allows a user's hand to access the grip handle 103 in the cavity 102 of the core member 101 from the top opening 108 at the top end 107*a* of the top weight member 107.

In another prophetic embodiment (not shown), the adjustable center mass weight apparatus 100 comprises the top weight member 107 with an opening 108 and a protrusion section 112 as illustrated in FIGS. 1A-1C; a core member 101 comprising coaxial openings 105 and 114 at the top end 101*a* and the bottom end 101*b* of the core member 101 as illustrated in FIGS. 1A-1C, FIG. 2D, FIG. 3D, and FIG. 3F; and a bottom weight member 109 with a protrusion section 110 extending outwardly in an upward direction from the top end 109*a* of the bottom weight member 109 as illustrated in FIG. 1A, FIG. 2D, and FIGS. 5A-5E. Furthermore, in this embodiment, the bottom weight member 109 comprises a closed bottom end 109*b*. The top weight member 107 is attached to the top end 101*a* of the core member 101 by screwably engaging the protrusion section 112 of the top weight member 107 with the opening 105 at the top end 101*a* of the core member 101. The bottom weight member 109 is attached to the bottom end 101*b* of the core member 101 by screwably engaging the protrusion section 110 of the bottom weight member 109 with the opening 114 at the bottom end 101*b* of the core member 101. In an embodiment, the protrusion section 110 of the bottom weight member 109 is closed-ended. In another embodiment, the protrusion section of the bottom weight member 109 is open-ended and in fluid communication with the opening 114 and the cavity 102 of the core member 101. When the top weight member 107 is attached to the top end 101*a* of the core member 101, the protrusion section 112 of the top weight member 107 is in fluid communication with the opening 105 and the cavity 102 of the core member 101. This embodiment of the adjustable center mass weight apparatus 100 allows a user's hand to access the grip handle 103 in the cavity 102 of the core member 101 from the top opening 108 at the top end 107*a* of the top weight member 107.

In another prophetic embodiment (not shown), the adjustable center mass weight apparatus 100 comprises a top weight member 107 with coaxial openings at the top end 107*a* and the bottom end 107*b* of the top weight member 107; a core member 101 comprising an open-ended protrusion section (not shown) extending outwardly in an upward direction from the top end 101*a* of the core member 101 and another protrusion section configured on the bottom end 101*b* of the core member 101; and a bottom weight member 109 comprising an opening configured at the top end 109*a* of the bottom weight member 109. In an embodiment, the protrusion section at the bottom end 101*b* of the core member 101 is close-ended. In another embodiment, the protrusion section at the bottom end 101*b* of the core member 101 is open-ended. Furthermore, in this embodiment, the bottom weight member 109 comprises the opening and the closed bottom end 109*b*. The top weight member 107 is attached to the top end 101*a* of the core member 101 by screwably engaging the opening at the bottom end 107*b* of the top weight member 107 with the protrusion section at the top end 101*a* of the core member 101. The bottom weight member 109 is attached to the bottom end 101*b* of the core member 101 by screwably engaging the protrusion section at the bottom end 101*b* of the core member 101 with the opening at the top end 109*a* of the bottom weight member 109. When the top weight member 107 is attached to the top end 101*a* of the core member 101, the coaxial openings of the top weight member 107 are in fluid communication with the open-ended protrusion section and the cavity 102 of the core member 101. This embodiment of the adjustable center mass weight apparatus 100 allows a user's hand to access the grip handle 103 in the cavity 102 of the core member 101 from the top opening 108 at the top end 107*a* of the top weight member 107.

The prophetic embodiments disclosed above allow insertion of a user's hand from only one end, that is, the top end 107*a* of the top weight member 107. In other embodiments, the adjustable center mass weight apparatus 100 is configured to allow a user's hand to access and grip the grip handle 103 from either the top opening 108 at the top end 107*a* of the top weight member 107 and/or from a bottom opening (not shown) at the bottom end 109*b* of the bottom weight member 109 as follows.

In another prophetic embodiment (not shown), the adjustable center mass weight apparatus 100 comprises a top weight member 107 comprising an opening 108 configured at the top end 107*a* of the top weight member 107 and an open-ended protrusion section 112 extending outwardly in a downward direction from the bottom end 107*b* of the top weight member 107 as illustrated in FIGS. 1A-1C; a core member 101 comprising coaxial openings 105 and 114 configured at the top end 101*a* and the bottom end 101*b* of the core member 101 as illustrated in FIGS. 1A-1C, FIG. 2D, FIG. 3D, and FIG. 3F; and a bottom weight member 109 comprising an open-ended protrusion section extending outwardly in an upward direction from the top end 109*a* of the bottom weight member 109 and an opening configured on the bottom end 109*b* of the bottom weight member 109. The opening at the bottom end 109*b* of the bottom weight member 109 extends inwardly from the bottom end 109*b* of the bottom weight member 109 and is in fluid communication with the protrusion section of the bottom weight member 109 and the cavity 102 of the core member 101 when the bottom weight member 109 is attached to the bottom end 101*b* of the core member 101. The protrusion section and the opening of the bottom weight member 109 in this embodiment are designed similar to the protrusion section 112 and the opening 108 of the top weight member 107, respectively, illustrated in FIGS. 1A-1C. The top weight member 107 is attached to the top end 101*a* of the core member 101 by screwably engaging the protrusion section 112 of the top weight member 107 with the opening 105 at the top end 101*a* of the core member 101. The bottom weight member 109 is attached to the bottom end 101*b* of the core member 101 by screwably engaging the protrusion section of the bottom weight member 109 with the opening 114 at the bottom end 101*b* of the core member 101. The openings at the top end 107*a* of the top weight member 107 and the bottom end 109*b* of the bottom weight member 109 in this embodiment convert the adjustable center mass weight apparatus 100 into a dual-handed weight apparatus, which allows a user's hand to access and grip the grip handle 103 in the cavity 102 of the core member 101 either from the top opening 108 at the top end 107*a* of the top weight member 107 or from the bottom opening at the bottom end 109*b* of the bottom weight member 109.

In another prophetic embodiment (not shown), the adjustable center mass weight apparatus 100 comprises a top weight member 107 with coaxial openings at the top end 107*a* and the bottom end 107*b* of the top weight member 107; a core member 101 comprising an open-ended protrusion section (not shown) extending outwardly in an upward direction from the top end 101*a* of the core member 101 and another open-ended protrusion section (not shown) configured on the bottom end 101*b* of the core member 101; and a bottom weight member 109 comprising coaxial openings configured at the top end 109*a* and the bottom end 109*b* of the bottom weight member 109. The top weight member 107 is attached to the top end 101*a* of the core member 101 by screwably engaging the opening at the bottom end 107*b* of the top weight member 107 with the protrusion section at the top end 101*a* of the core member 101. The bottom weight member 109 is attached to the bottom end 101*b* of the core member 101 by screwably engaging the protrusion section at the bottom end 101*b* of the core member 101 with the opening at the top end 109*a* of the bottom weight member 109. When the top weight member 107 is attached to the top end 101*a* of the core member 101, the coaxial openings of the top weight member 107 are in fluid communication with the open-ended protrusion section at the top end 101*a* of the core member 101 and with the cavity 102 of the core member 101. Similarly, when the bottom weight member 109 is attached to the bottom end 109*b* of the bottom weight member 109, the coaxial openings of the bottom weight member 109 are in fluid communication with the open-ended protrusion section at the bottom end 101*b* of the core member 101 and with the cavity 102 of the core member 101. The openings at the top end 107*a* of the top weight member 107 and the bottom end 109*b* of the bottom weight member 109 in this embodiment convert the adjustable center mass weight apparatus 100 into a dual-handed weight apparatus, which allows a user's hand to access and grip the grip handle 103 in the cavity 102 of the core member 101 either from the top opening 108 at the top end 107*a* of the top weight member 107 or from the bottom opening at the bottom end 109*b* of the bottom weight member 109.

In various other embodiments, different configurations of attachment mechanisms, for example, openings and protrusion sections, are interchangeably configured in the top weight member 107, the core member 101, and the bottom weight member 109, to allow functionally equivalent mateable connections and engagements of the top weight member 107 and the bottom weight member 109 to the core member 101, in addition to allowing access of the grip handle 103 from one of the ends 107*a* and 109*b* or both the ends 107*a* and 109*b* of the adjustable center mass weight apparatus 100.

Figure 6:
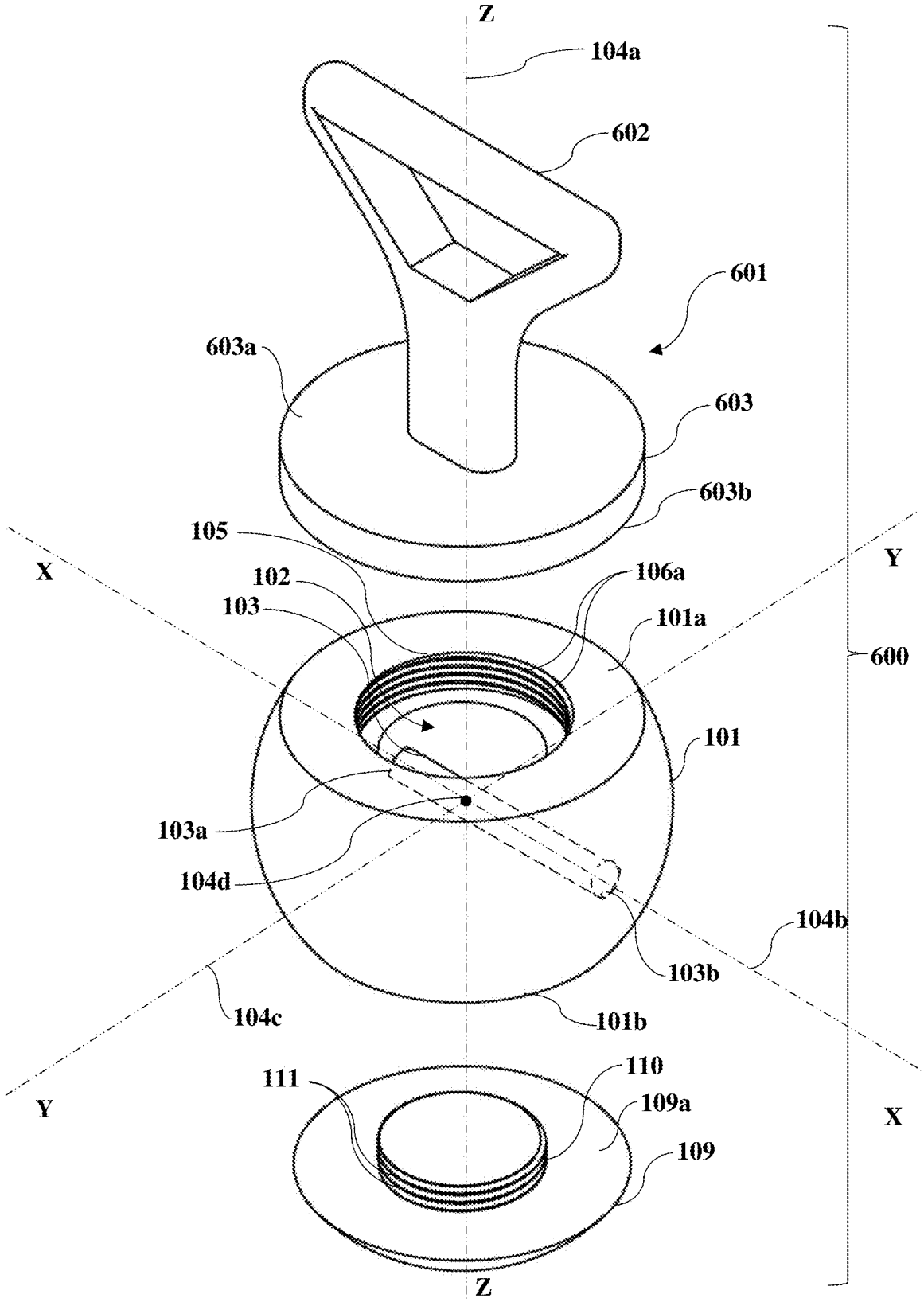
FIG. 6 illustrates an exploded, top perspective view of an embodiment of the adjustable center mass weight apparatus.

FIG. 6 illustrates an exploded, top perspective view of another embodiment of the adjustable center mass weight apparatus 600. The adjustable center mass weight apparatus 600 comprises the generally spherical, hollow core member 101 and incremental weight members 601 and 109. In this embodiment, the incremental weight members comprise a top handle attachment 601 and a bottom weight member 109 as illustrated in FIG. 6. In this embodiment, the core member 101 comprises two coaxial openings 105 and 114 configured on the top end 101*a* and the bottom end 101*b* of the core member 101, respectively, as illustrated in FIGS. 1A-1C, FIG. 2D, FIG. 3D, and FIG. 3F. The structure and the function of the core member 101 are disclosed in the descriptions of FIGS. 1A-1C and FIGS. 3A-3F. Furthermore, in this embodiment, the bottom weight member 109 is a generally spherical cap comprising weight grooves 111 configured on the protruding section 110 extending outwardly in an upward direction from the top end 109*a* of the bottom weight member 109 as illustrated in FIG. 6. The structure and the function of the bottom weight member 109 are disclosed in the descriptions of FIGS. 1A-1C and FIGS. 5A-5E. The bottom weight member 109 is configured to engage with the core grooves 106*b* at the bottom end 101*b* of the core member 101 as illustrated in FIG. 2D and as disclosed in the description of FIGS. 2A-2D. The top handle attachment 601 is configured to convert the adjustable center mass weight apparatus 600 into another useable weight apparatus, for example, a kettlebell, for facilitating additional strength training exercises, for example, swings, carries, etc.

Figure 8A:
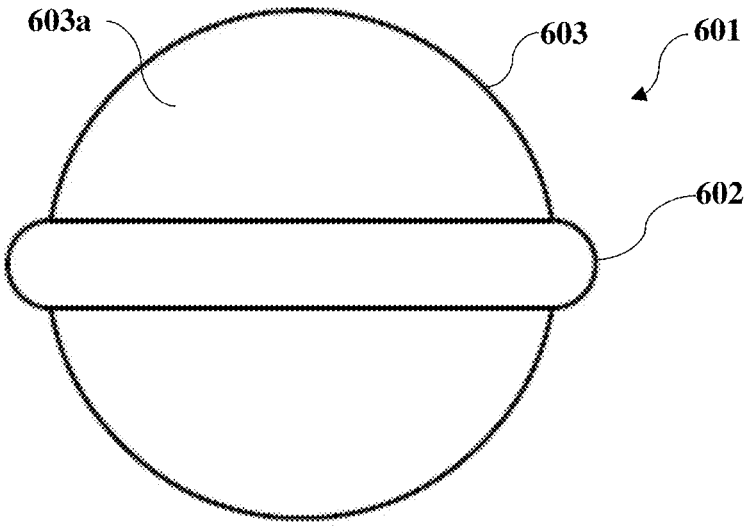
FIG. 8A illustrates a top plan view of a top handle attachment of the embodiment of the adjustable center mass weight apparatus shown in FIG. 7A.
Figure 8B:
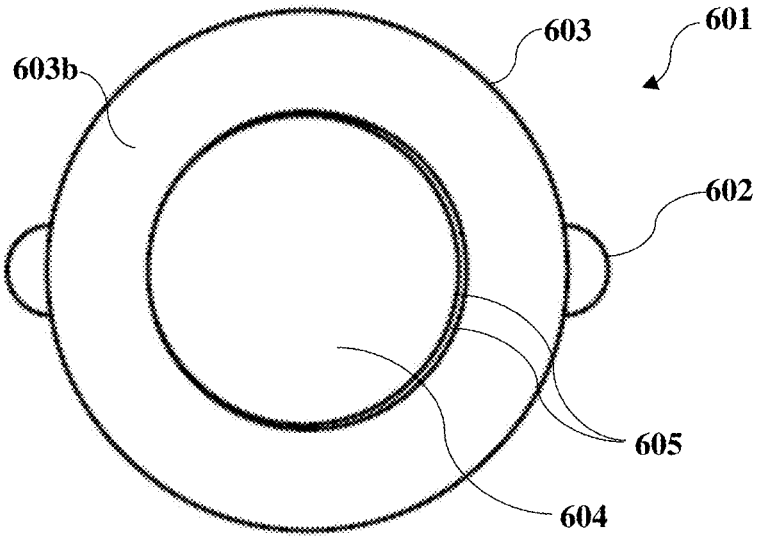
FIG. 8B illustrates a bottom elevation view of the top handle attachment shown in FIG. 8A.
Figure 8C:
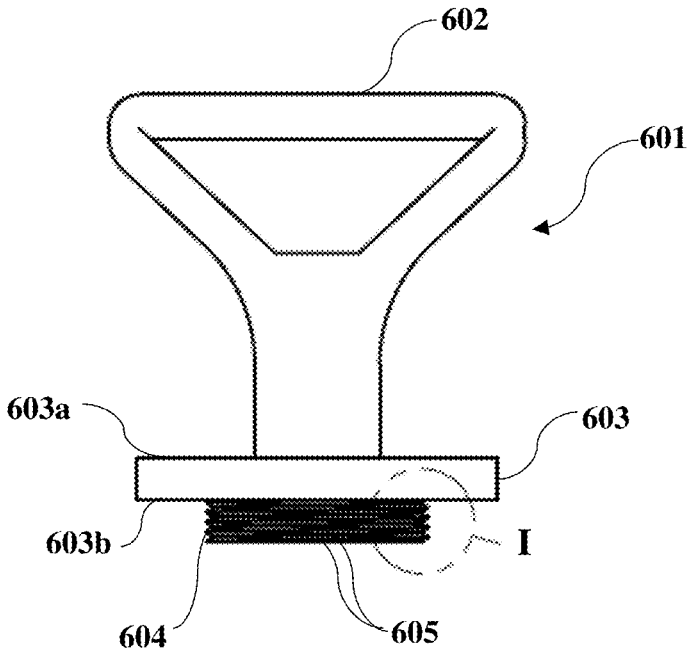
FIG. 8C illustrates a front elevation view of the top handle attachment shown in FIG. 8A.

In an embodiment, the top handle attachment 601 comprises a grip handle 602, a support member 603, and a protruding section 604 as illustrated in FIGS. 8A-8D. In an example, the dimensions of the grip handle 602 comprise a thickness of about 1.14 inches, a width of about 5 inches, and a height of about 8 inches. In an example, the dimensions of the support member 603 comprise a width of about 5 inches and a height of about 1 inch. The grip handle 602 of the top handle attachment 601 is attached to and extends upwardly from a top end 603*a* of the support member 603. In an embodiment as illustrated in FIG. 11, the support member 603 is configured in the shape of a disc. The protruding section 604 of the top handle attachment 601 extends outwardly in a downward direction from a bottom end 603*b* of the support member 603 as illustrated in FIG. 8C. In an embodiment, the top handle attachment 601 further comprises handle grooves 605 configured on the protruding section 604 of the top handle attachment 601. The handle grooves 605 of the top handle attachment 601 are configured to engage with the core grooves 106*a* at the top end 101*a* of the core member 101 to attach the top handle attachment 601 to the top end 101*a* of the core member 101.

The top handle attachment 601 and the bottom weight member 109 are screwed onto the top end 101*a* and the bottom end 101*b* of the core member 101, respectively. When the top handle attachment 601 is screwed onto the top end 101*a* of the core member 101, the handle grooves 605, for example, external screw threads, configured on the protruding section 604 of the top handle attachment 601 illustrated in FIG. 8C, engage with the core grooves 106*a*, for example, internal screw threads, configured in the opening 105 at the top end 101*a* of the core member 101 illustrated in FIG. 6, to attach the top handle attachment 601 to the top end 101*a* of the core member 101. When the bottom weight member 109 is screwed onto the bottom end 101*b* of the core member 101, the weight grooves 111, for example, external screw threads, configured on the protruding section 110 at the top end 109*a* of the bottom weight member 109 illustrated in FIG. 6, engage with the core grooves 106*b*, for example, internal screw threads, configured in the opening 114 of the core member 101 illustrated in FIG. 3B and FIG. 3D, to attach the bottom weight member 109 to the bottom end 101*b* of the core member 101.

Figure 7A:
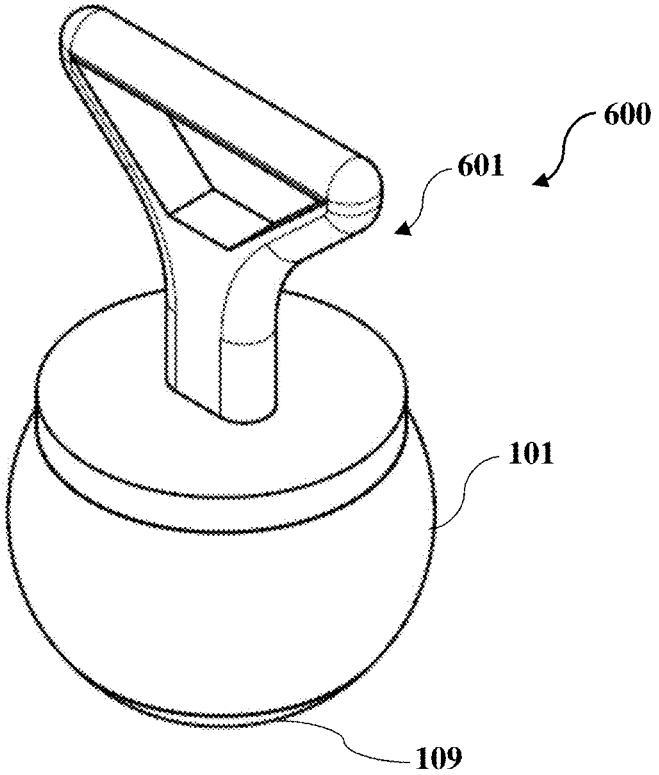
FIG. 7A illustrates a top perspective view of the assembled adjustable center mass weight apparatus shown in FIG. 6.

FIG. 7A illustrates a top perspective view of the assembled adjustable center mass weight apparatus 600 shown in FIG. 6. In an embodiment, the adjustable center mass weight apparatus 600 is assembled by engaging the top handle attachment 601 and the bottom weight member 109 to the top end 101*a* and the bottom end 101*b* of the core member 101, respectively, as illustrated in FIG. 7A. The adjustable center mass weight apparatus 600 is made, for example, of cast iron, steel, etc.

Figure 7B:
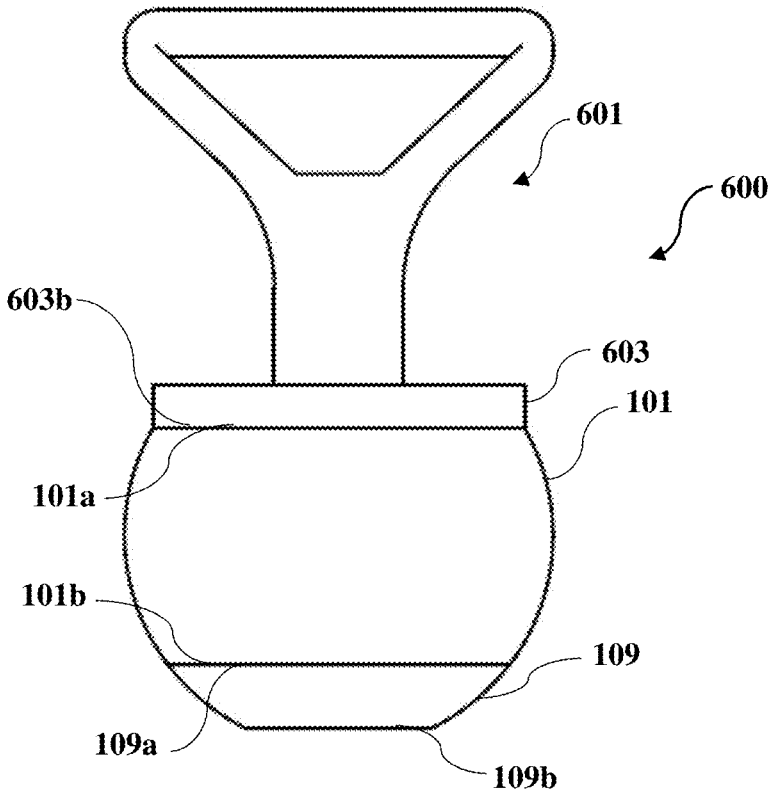
FIG. 7B illustrates a front elevation view of the adjustable center mass weight apparatus shown in FIG. 7A, the rear elevation view being a mirror image thereof.

FIG. 7B illustrates a front elevation view of the adjustable center mass weight apparatus 600 shown in FIG. 7A, the rear elevation view being a mirror image thereof. When the top handle attachment 601 is engaged to the top end 101*a* of the core member 101, the bottom end 603*b* of the support member 603 of the top handle attachment 601 lies flush against the top end 101*a* of the core member 101. Similarly, when the bottom weight member 109 is engaged to the bottom end 101*b* of the core member 101, the top end 109*a* of the bottom weight member 109 lies flush against the bottom end 101*b* of the core member 101. In an embodiment as illustrated in FIG. 7B, the bottom end 109*b* of the bottom weight member 109 provides a flat surface for firm and convenient storage of the adjustable center mass weight apparatus 600 on another flat surface. The adjustable center mass weight apparatus 600 may be stored by placing the bottom end 109*b* of the bottom weight member 109 on another flat surface.

Figure 7C:
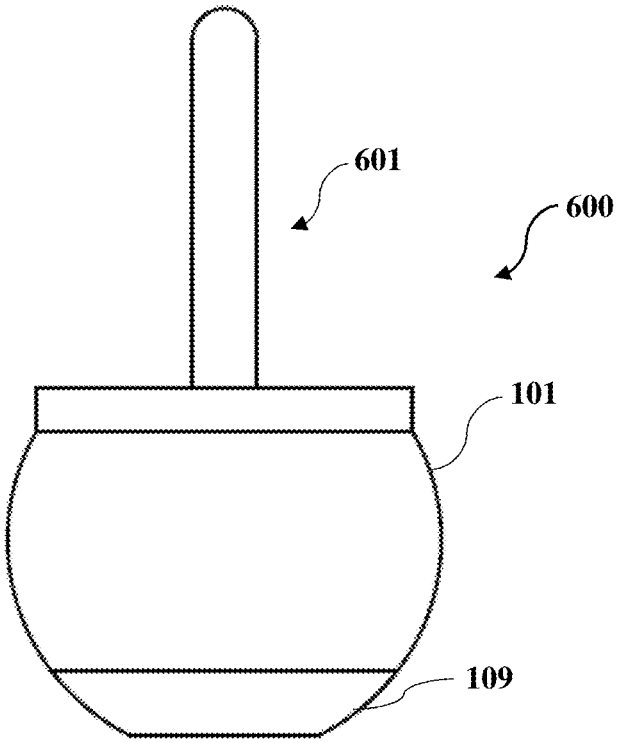
FIG. 7C illustrates a right-side elevation view of the adjustable center mass weight apparatus shown in FIG. 7A, the left-side elevation view being a mirror image thereof.

FIG. 7C illustrates a right-side elevation view of the adjustable center mass weight apparatus 600 shown in FIG. 7A, the left-side elevation view being a mirror image thereof. In an example, the adjustable center mass weight apparatus 600 allows a 20-lb core member 101 to become a 25-lb, 30-lb, 35-lb, or 40-lb weight with the addition of the top handle attachment 601 and the bottom weight member 109. In another example, the adjustable center mass weight apparatus 600 allows a 20-lb core member 101 to become a 25-lb, 30-lb, 35-lb, or 40-lb weight with the addition of the top handle attachment 601 only.

Figure 7D:
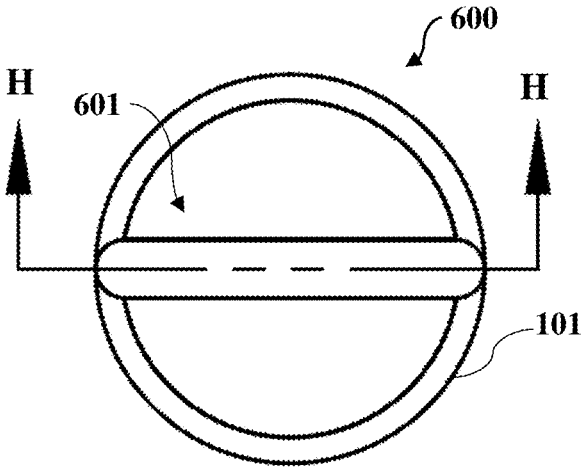
FIG. 7D illustrates a top plan view of the adjustable center mass weight apparatus shown in FIG. 7A.

FIG. 7D illustrates a top plan view of the adjustable center mass weight apparatus 600 shown in FIG. 7A. The top plan view in FIG. 7D illustrates the top handle attachment 601 disposed on the core member 101 of the adjustable center mass weight apparatus 600.

Figure 7E:
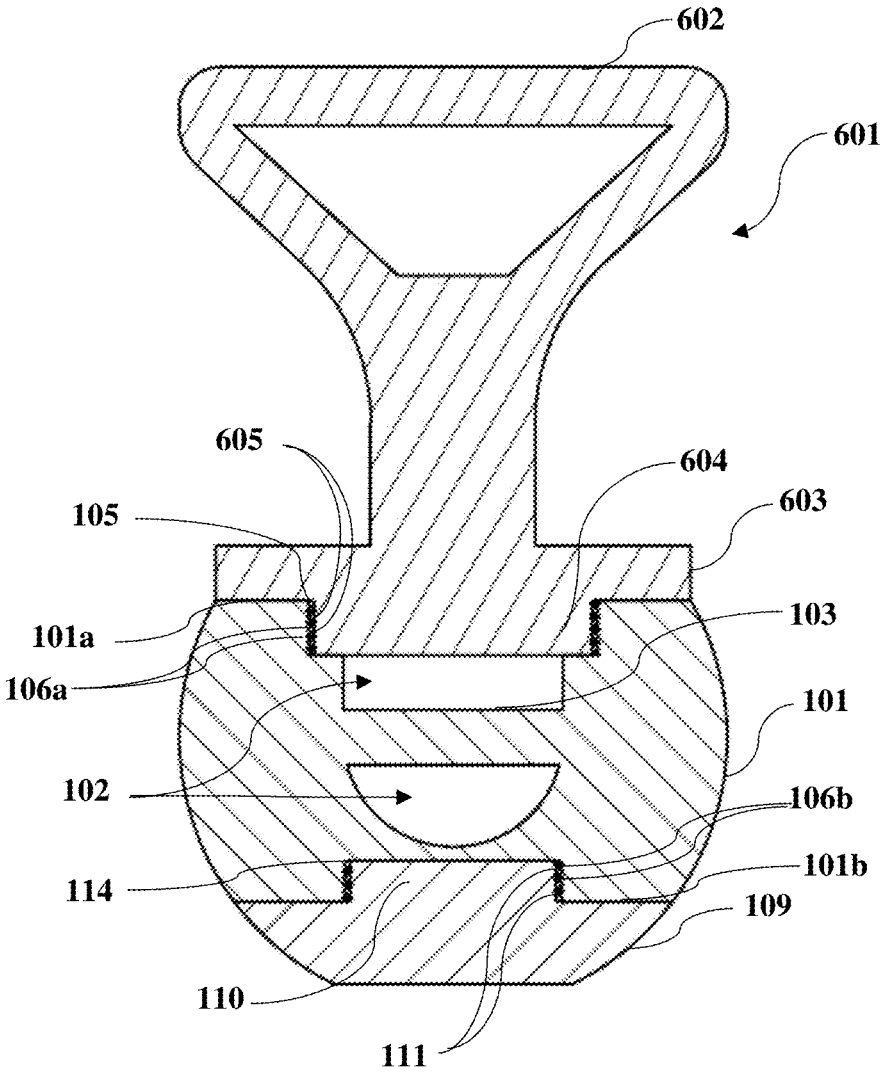
FIG. 7E illustrates a cross-sectional view of the adjustable center mass weight apparatus shown in FIG. 7A, taken along a sectional line H-H shown in FIG. 7D.

FIG. 7E illustrates a cross-sectional view of the adjustable center mass weight apparatus 600 shown in FIG. 7A, taken along a sectional line H-H shown in FIG. 7D. The cross-sectional view in FIG. 7E illustrates the engagement of the top handle attachment 601 and the bottom weight member 109 with the top end 101*a* and the bottom end 101*b* of the core member 101, respectively. The top handle attachment 601 and the bottom weight member 109 are screwed onto the top end 101*a* and the bottom end 101*b* of the core member 101, respectively. When the top handle attachment 601 is screwed onto the top end 101*a* of the core member 101, the handle grooves 605, for example, external screw threads, configured on the protruding section 604 of the top handle attachment 601, engage with the core grooves 106*a*, for example, internal screw threads, configured in the opening 105 at the top end 101*a* of the core member 101 illustrated in FIG. 6, to attach the top handle attachment 601 to the top end 101*a* of the core member 101. When the bottom weight member 109 is screwed onto the bottom end 101*b* of the core member 101, the weight grooves 111, for example, external screw threads, configured on the protruding section 110 of the bottom weight member 109, engage with the core grooves 106*b*, for example, internal screw threads, configured in the opening 114 of the core member 101, to attach the bottom weight member 109 to the bottom end 101*b* of the core member 101.

FIG. 8A illustrates a top plan view of the top handle attachment 601 of the embodiment of the adjustable center mass weight apparatus 600 shown in FIG. 7A. The top plan view in FIG. 8A illustrates the grip handle 602 disposed on the top end 603*a* of the support member 603. In an example, the diameter of the support member 603 of the top handle attachment 601 is from about 1.46 inches to about 1.57 inches.

FIG. 8B illustrates a bottom elevation view of the top handle attachment 601 shown in FIG. 8A. The bottom elevation view in FIG. 8B illustrates the protruding section 604 with the handle grooves 605 disposed at the bottom end 603*b* of the support member 603 of the top handle attachment 601.

FIG. 8C illustrates a front elevation view of the top handle attachment 601 shown in FIG. 8A. The front elevation view in FIG. 8C illustrates the grip handle 602 extending upwardly from the top end 603*a* of the support member 603 of the top handle attachment 601, and the protruding section 604 with the handle grooves 605 configured thereon, extending downwardly from the bottom end 603*b* of the support member 603. In an example, the height of the grip handle 602 of the top handle attachment 601 is from about 5 inches to about 6 inches, and the thickness of the support member 603 is from about 1.5 inches to about 2 inches. In an example, the diameter of the protruding section 604 of the top handle attachment 601 is from about 4 inches to about 6 inches. Furthermore, in an example, the height of the protruding section 604 of the top handle attachment 601 is from about 1 inch to about 1.5 inches. The upper half of the grip handle 602 is configured in different shapes, for example, an inverted trapezoidal shape, a round shape, a rectangular shape, etc.

Figure 8D:
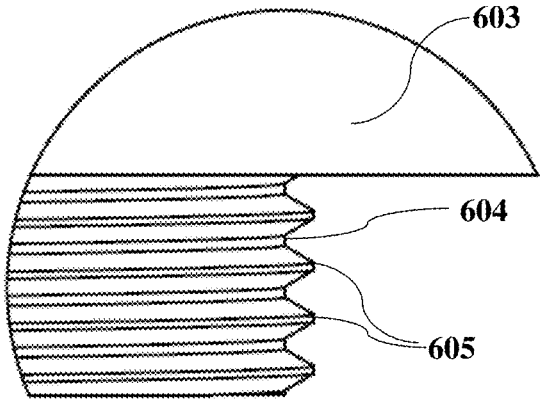
FIG. 8D illustrates an enlarged view of a portion marked I in FIG. 8C, showing handle grooves configured on a protruding section of the top handle attachment.

FIG. 8D illustrates an enlarged view of a portion marked I in FIG. 8C, showing the handle grooves 605 configured on the protruding section 604 of the top handle attachment 601. In an embodiment, the handle grooves 605 of the top handle attachment 601 are outer grooves, for example, external screw threads, as illustrated in FIG. 8D.

Figure 9:
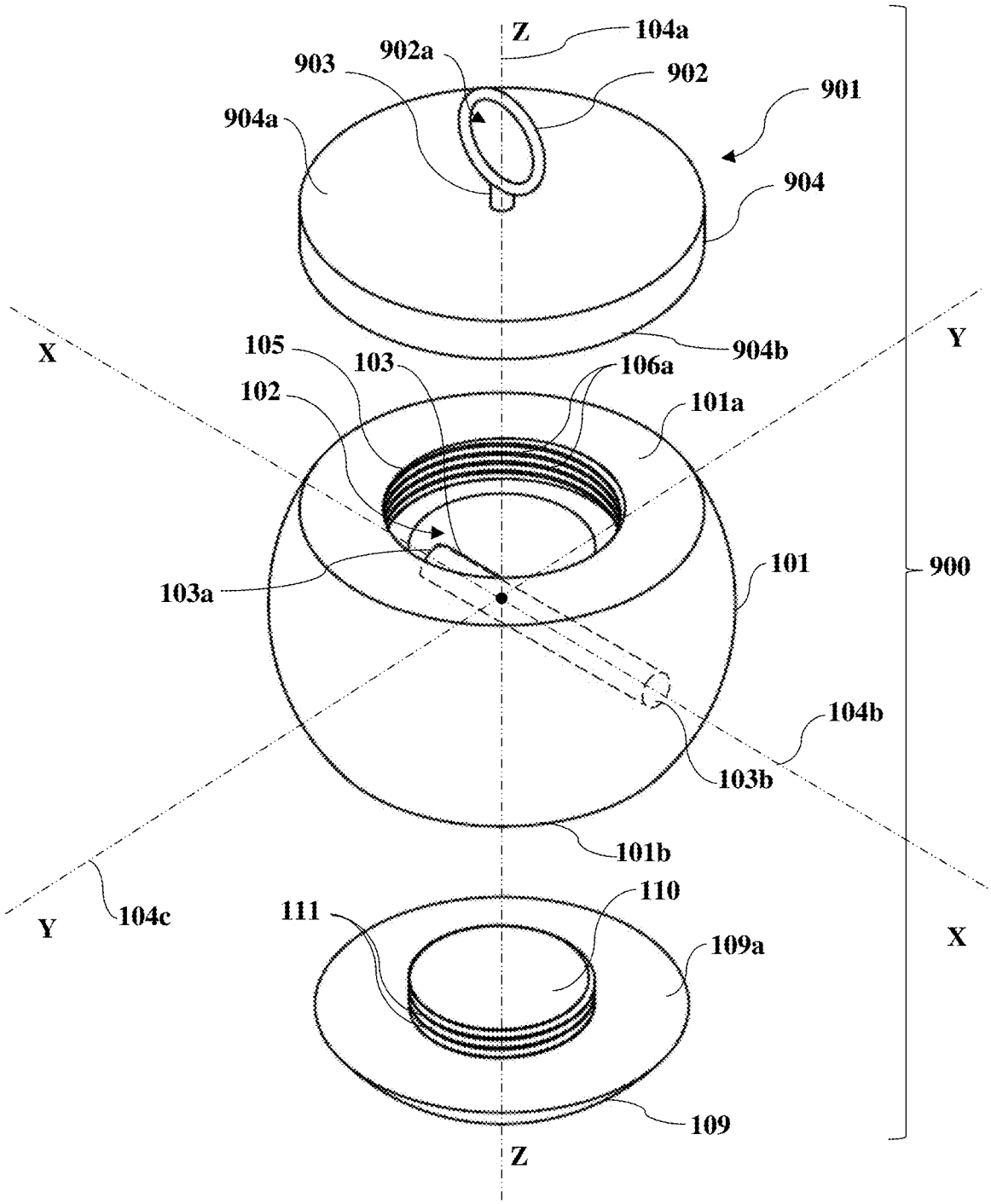
FIG. 9 illustrates an exploded, top perspective view of another embodiment of the adjustable center mass weight apparatus.

FIG. 9 illustrates an exploded, top perspective view of another embodiment of the adjustable center mass weight apparatus 900. The adjustable center mass weight apparatus 900 comprises the generally spherical, hollow core member 101 and incremental weight members 901 and 109. In this embodiment, the incremental weight members comprise a top handle attachment 901 and a bottom weight member 109 as illustrated in FIG. 9. In this embodiment, the core member 101 comprises two coaxial openings 105 and 114 configured on the top end 101*a* and the bottom end 101*b* of the core member 101, respectively, as illustrated in FIGS. 1A-1C, FIG. 2D, FIG. 3D, and FIG. 3F. The structure and the function of the core member 101 are disclosed in the descriptions of FIGS. 1A-1C and FIGS. 3A-3F. Furthermore, in this embodiment, the bottom weight member 109 is a generally spherical cap comprising weight grooves 111 configured on the protruding section 110 extending outwardly in an upward direction from the top end 109*a* of the bottom weight member 109 as illustrated in FIG. 9. The structure and the function of the bottom weight member 109 are disclosed in the descriptions of FIGS. 1A-1C and FIGS. 5A-5E. The bottom weight member 109 is configured to engage with the core grooves 106*b* at the bottom end 101*b* of the core member 101 as illustrated in FIG. 2D and as disclosed in the description of FIGS. 2A-2D. The top handle attachment 901 is configured to convert the adjustable center mass weight apparatus 900 into another weight apparatus useable with accessories, for example, a leather strap with looped handles, a rope with knotted ends, etc., for facilitating additional strength training exercises.

Figure 11A:
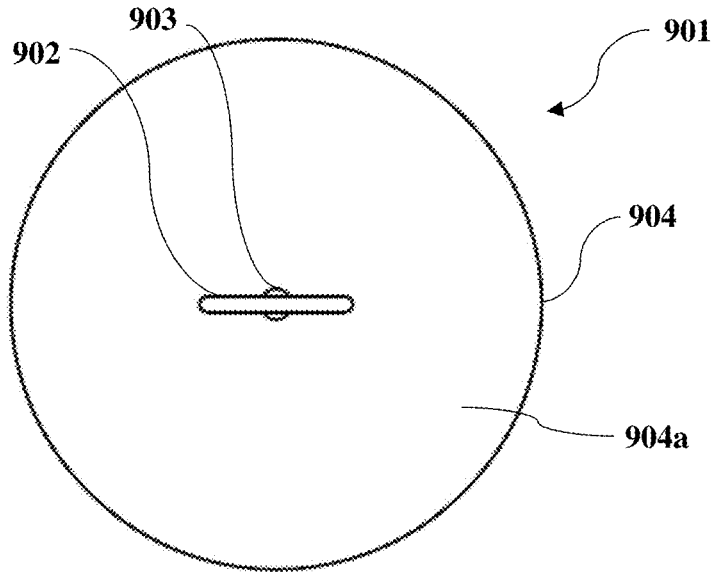
FIG. 11A illustrates a top plan view of a top handle attachment of the embodiment of the adjustable center mass weight apparatus shown in FIG. 10A.
Figure 11B:
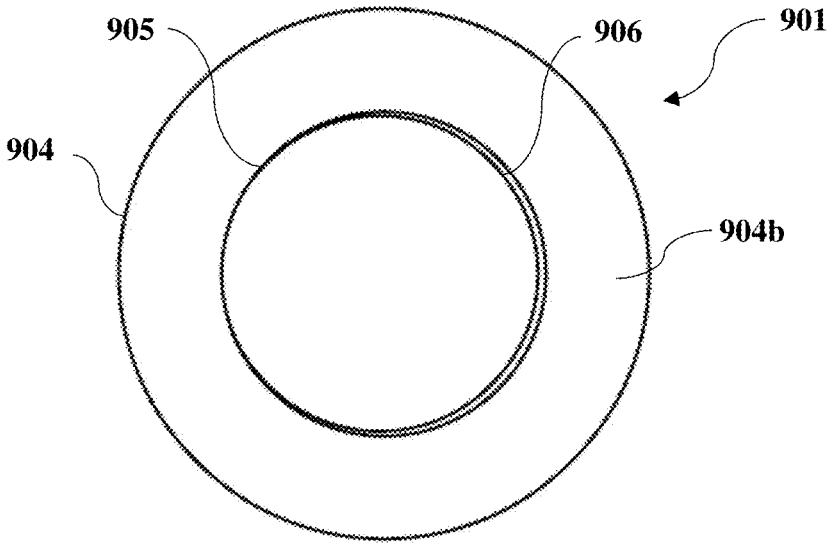
FIG. 11B illustrates a bottom elevation view of the top handle attachment shown in FIG. 11A.
Figure 11C:
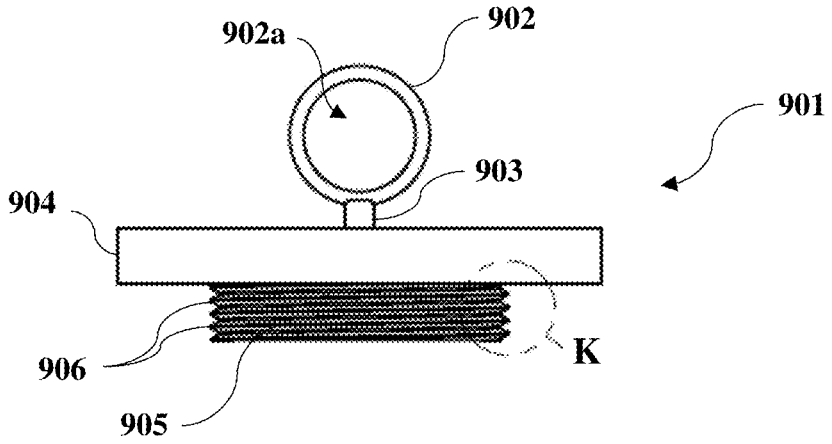
FIG. 11C illustrates a front elevation view of the top handle attachment shown in FIG. 11A.

In an embodiment, the top handle attachment 901 comprises a ring element 902, a support member 904, and a protruding section 905 as illustrated in FIGS. 11A-11D. In an embodiment, the diameter of the ring element 902 is about 3 inches, and the height of the support member 904 is about 1 inch. The ring element 902 of the top handle attachment 901 is attached to and extends upwardly from a top end 904*a* of the support member 904, via an extension 903. The extension 903 provides support to the ring element 902 on the support member 904. In an embodiment, the ring element 902 comprises an opening 902*a* configured to receive a training accessory 1200 as disclosed in the descriptions of FIGS. 12A-12F and FIGS. 13A-13E. In an embodiment as illustrated in FIG. 9, the support member 904 is configured in the shape of a disc. The protruding section 905 of the top handle attachment 901 extends outwardly in a downward direction from a bottom end 904*b* of the support member 904 as illustrated in FIG. 11C. In an embodiment, the top handle attachment 901 further comprises handle grooves 906 configured on the protruding section 905 of the top handle attachment 901. The handle grooves 906 of the top handle attachment 901 are configured to engage with the core grooves 106*a* at the top end 101*a* of core member 101 to attach the top handle attachment 901 to the top end 101*a* of the core member 101.

The top handle attachment 901 and the bottom weight member 109 are screwed onto the top end 101*a* and the bottom end 101*b* of the core member 101, respectively. When the top handle attachment 901 is screwed onto the top end 101*a* of the core member 101, the handle grooves 906, for example, external screw threads, configured on the protruding section 905 of the top handle attachment 901 illustrated in FIG. 11C, engage with the core grooves 106*a*, for example, internal screw threads, configured in the opening 105 at the top end 101*a* of the core member 101 illustrated in FIG. 9, to attach the top handle attachment 901 to the top end 101*a* of the core member 101. When the bottom weight member 109 is screwed onto the bottom end 101*b* of the core member 101, the weight grooves 111, for example, external screw threads, configured on the protruding section 110 at the top end 109*a* of the bottom weight member 109 illustrated in FIG. 9, engage with the core grooves 106*b*, for example, internal screw threads, configured in the opening 114 of the core member 101 illustrated in FIGS. 1B-1C and FIG. 3B, to attach the bottom weight member 109 to the bottom end 101*b* of the core member 101.

Figure 10A:
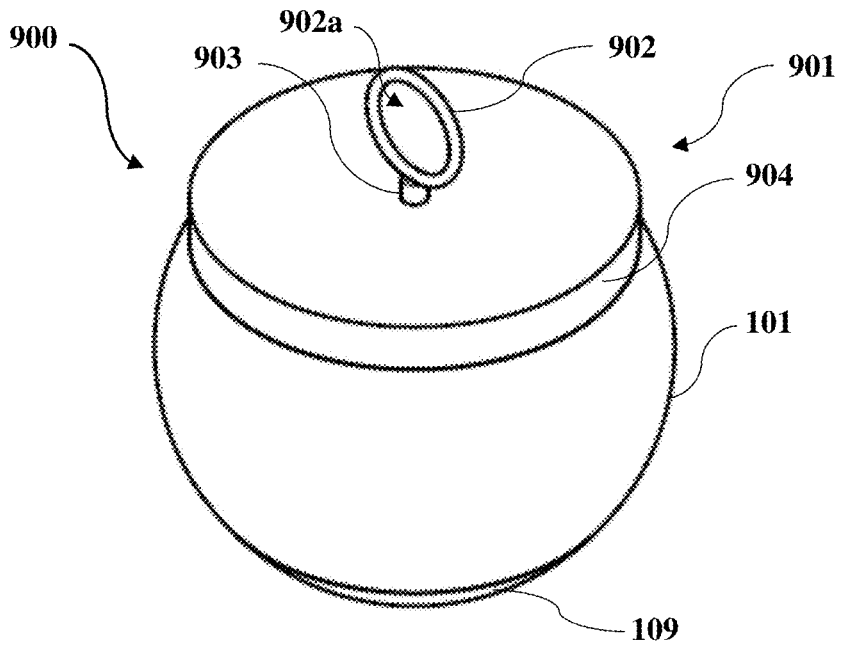
FIG. 10A illustrates a top perspective view of the assembled adjustable center mass weight apparatus shown in FIG. 9.

FIG. 10A illustrates a top perspective view of the assembled adjustable center mass weight apparatus 900 shown in FIG. 9. In an embodiment, the adjustable center mass weight apparatus 900 is assembled by engaging the top handle attachment 901 and the bottom weight member 109 to the top end 101*a* and the bottom end 101*b* of the core member 101, respectively, as illustrated in FIG. 10A. The adjustable center mass weight apparatus 900 is made, for example, of cast iron, steel, etc.

Figure 10B:
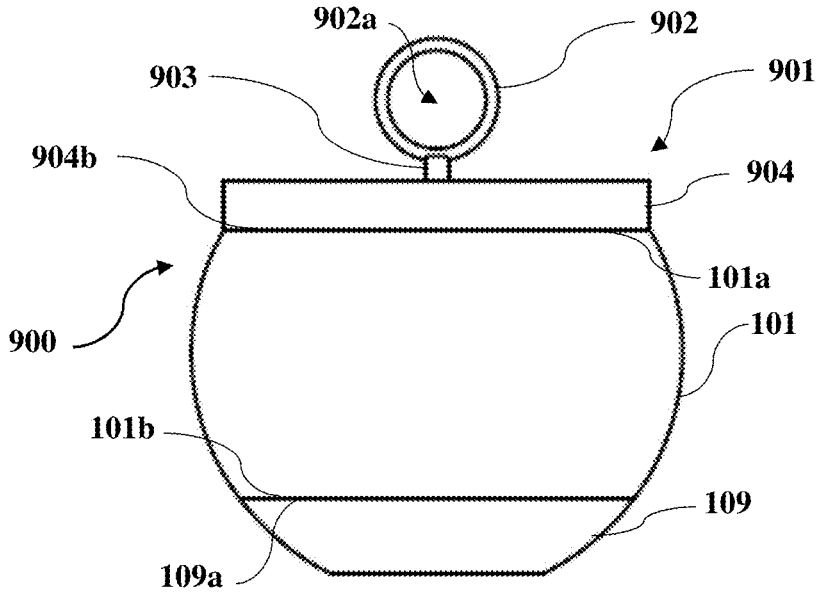
FIG. 10B illustrates a front elevation view of the adjustable center mass weight apparatus shown in FIG. 10A.

FIG. 10B illustrates a front elevation view of the adjustable center mass weight apparatus 900 shown in FIG. 10A. When the top handle attachment 901 is engaged to the top end 101*a* of the core member 101, the bottom end 904*b* of the support member 904 of the top handle attachment 901 lies flush against the top end 101*a* of the core member 101. Similarly, when the bottom weight member 109 is engaged to the bottom end 101*b* of the core member 101, the top end 109*a* of the bottom weight member 109 lies flush against the bottom end 101*b* of the core member 101. In an embodiment as illustrated in FIG. 10B, the bottom end 109*b* of the bottom weight member 109 provides a flat surface for firm and convenient storage of the adjustable center mass weight apparatus 900 on another flat surface. The adjustable center mass weight apparatus 900 may be stored by placing the bottom end 109*b* of the bottom weight member 109 on another flat surface.

Figure 10C:
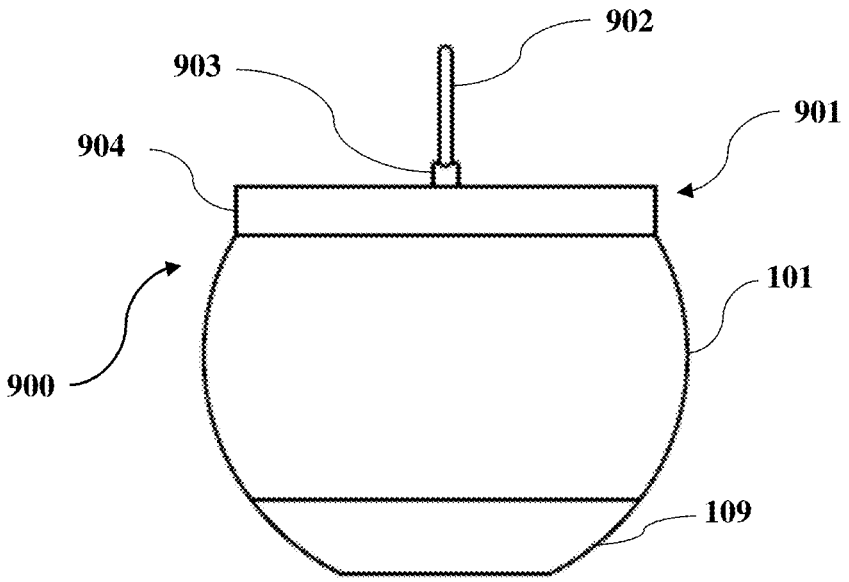
FIG. 10C illustrates a right-side elevation view of the adjustable center mass weight apparatus shown in FIG. 10A, the left-side elevation view being a mirror image thereof.

FIG. 10C illustrates a right-side elevation view of the adjustable center mass weight apparatus 900 shown in FIG. 10A, the left-side elevation view being a mirror image thereof. In an example, the adjustable center mass weight apparatus 900 allows a 20-lb core member 101 to become a 25-lb, 30-lb, 35-lb, or 40-lb weight with the addition of the top handle attachment 901 and the bottom weight member 109. In another example, the adjustable center mass weight apparatus 900 allows a 20-lb core member 101 to become a 25-lb, 30-lb, 35-lb, or 40-lb weight with the addition of the top handle attachment 901 only.

Figure 10D:
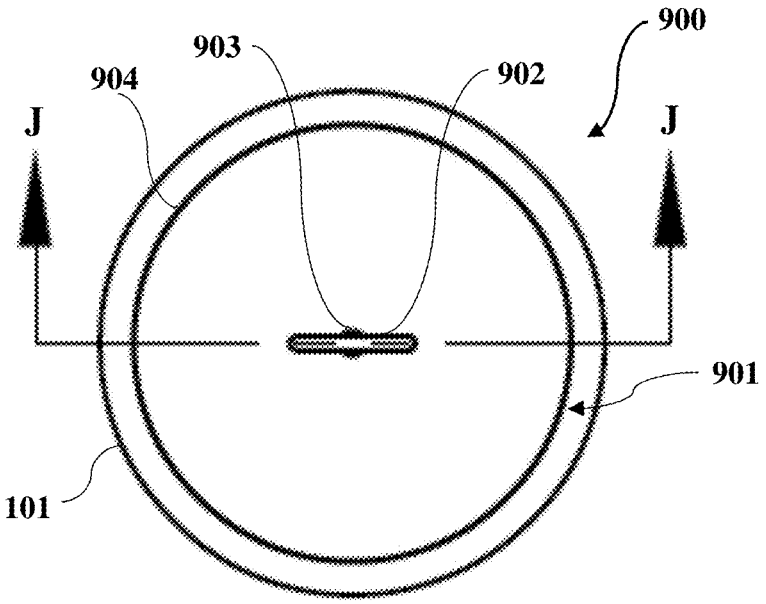
FIG. 10D illustrates a top plan view of the adjustable center mass weight apparatus shown in FIG. 10A.

FIG. 10D illustrates a top plan view of the adjustable center mass weight apparatus 900 shown in FIG. 10A. The top plan view in FIG. 10D illustrates the top handle attachment 901 with its ring element 902 and support member 904 disposed on the core member 101 of the adjustable center mass weight apparatus 900.

Figure 10E:
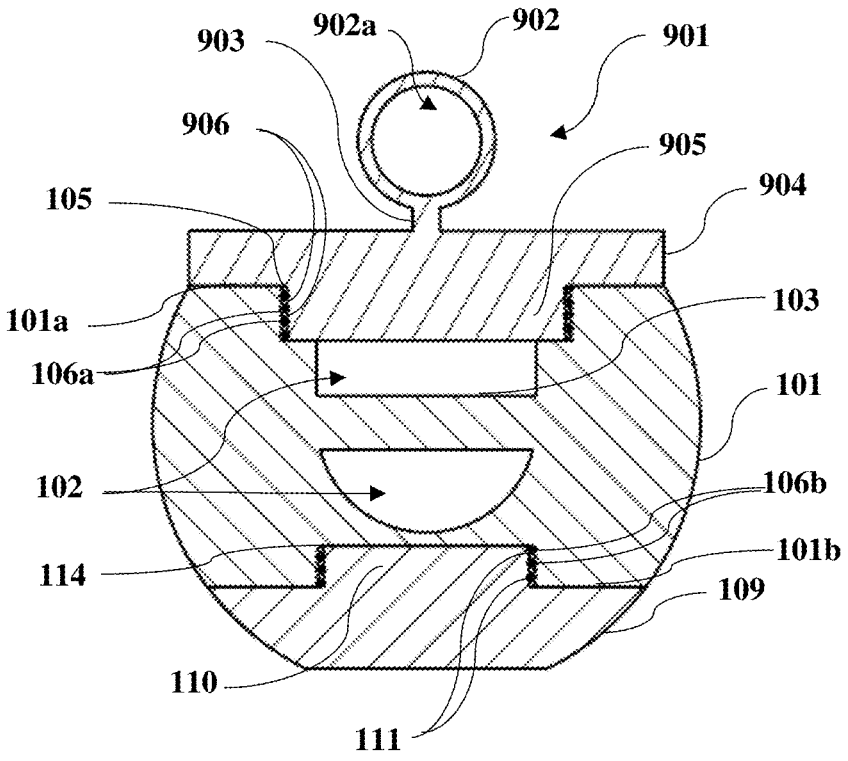
FIG. 10E illustrates a cross-sectional view of the adjustable center mass weight apparatus shown in FIG. 10A, taken along a sectional line J-J shown in FIG. 10D.

FIG. 10E illustrates a cross-sectional view of the adjustable center mass weight apparatus 900 shown in FIG. 10A, taken along a sectional line J-J shown in FIG. 10D. The cross-sectional view in FIG. 10E illustrates the engagement of the top handle attachment 901 and the bottom weight member 109 to the top end 101*a* and the bottom end 101*b* of the core member 101, respectively. The top handle attachment 901 and the bottom weight member 109 are screwed onto the top end 101*a* and the bottom end 101*b* of the core member 101, respectively. When the top handle attachment 901 is screwed onto the top end 101*a* of the core member 101, the handle grooves 906, for example, external screw threads, configured on the protruding section 905 of the top handle attachment 901, engage with the core grooves 106*a*, for example, internal screw threads, configured in the opening 105 at the top end 101*a* of the core member 101 illustrated in FIG. 9, to attach the top handle attachment 901 to the top end 101*a* of the core member 101. When the bottom weight member 109 is screwed onto the bottom end 101*b* of the core member 101, the weight grooves 111, for example, external screw threads, configured on the protruding section 110 of the bottom weight member 109, engage with the core grooves 106*b*, for example, internal screw threads, configured in the opening 114 of the core member 101, to attach the bottom weight member 109 to the bottom end 101*b* of the core member 101.

FIG. 11A illustrates a top plan view of the top handle attachment 901 of the embodiment of the adjustable center mass weight apparatus 900 shown in FIG. 10A. The top plan view in FIG. 11A illustrates the ring element 902 disposed on the top end 904*a* of the support member 904 via the extension 903. In an example, the diameter of the support member 904 of the top handle attachment 901 is from about 5 inches to about 6 inches.

FIG. 11B illustrates a bottom elevation view of the top handle attachment 901 shown in FIG. 11A. The bottom elevation view in FIG. 11B illustrates the protruding section 905 with the handle grooves 906 disposed at the bottom end 904*b* of the support member 904 of the top handle attachment 901.

FIG. 11C illustrates a front elevation view of the top handle attachment 901 shown in FIG. 11A. The front elevation view in FIG. 11C illustrates the ring element 902 extending upwardly from the top end 904*a* of the support member 904 of the top handle attachment 901 via the extension 903, and the protruding section 905 with the handle grooves 906 configured thereon, extending downwardly from the bottom end 904*b* of the support member 904. In an example, the diameter of the ring element 902 of the top handle attachment 901 is from about 2.5 inches to about 3 inches; the height of the extension 903 is from about 0.5 inches to about 0.95 inches; and the thickness of the support member 904 is from about 1 inch to about 1.25 inches. Furthermore, in an example, the height of the protruding section 905 of the top handle attachment 901 is from about 1 inch to about 1.25 inches.

Figure 11D:
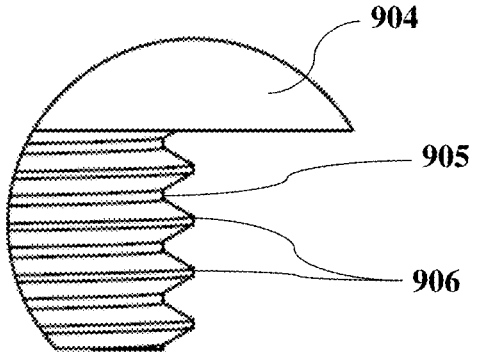
FIG. 11D illustrates an enlarged view of a portion marked K in FIG. 11C, showing handle grooves configured on a protruding section of the top handle attachment.

FIG. 11D illustrates an enlarged view of a portion marked K in FIG. 11C, showing handle grooves 906 configured on the protruding section 905 of the top handle attachment 901. In an embodiment, the handle grooves 906 of the top handle attachment 901 are outer grooves, for example, external screw threads, as illustrated in FIG. 11D.

Figure 12A:
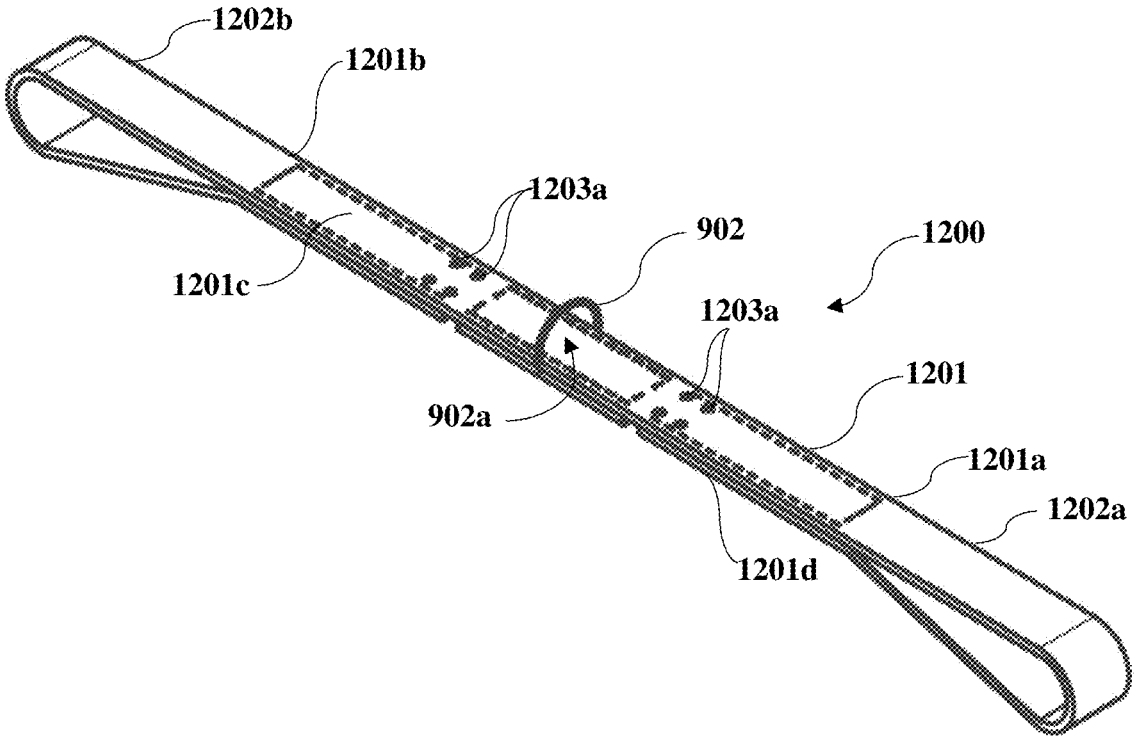
FIG. 12A illustrates a top perspective view of a training accessory inserted into a ring element of an embodiment of the top handle attachment shown in FIG. 10A.

FIG. 12A illustrates a top perspective view of a training accessory 1200 inserted into the ring element 902 of an embodiment of the top handle attachment 901 shown in FIG. 10A. In an embodiment as illustrated in FIG. 12A, the training accessory 1200 is a strap accessory comprising a strap member 1201 made, for example, of leather. In an embodiment, the strap member 1201 comprises two loop elements or handles 1202*a* and 1202*b* folded at the opposing ends 1201*a* and 1201*b* of the strap member 1201, respectively, from an upper surface 1201*c* of the strap member 1201 to a lower surface 1201*d* of the strap member 1201. The loop elements 1202*a* and 1202*b* are attached to the lower surface 1201*d* of the strap member 1201 using fasteners 1203*a*, for example, rivet-like fasteners. After the adjustable center mass weight apparatus 900 illustrated in FIG. 10A is assembled, the training accessory 1200 is inserted into the opening 902*a* of the ring element 902 as illustrated in FIGS. 12A-12C and FIG. 12E. A user may then insert hands through the loop elements 1202*a* and 1202*b* to support the user's wrists, wrap the strap member 1201 around the hands, and lift the adjustable center mass weight apparatus 900 that is suspended from the center of the strap member 1201 to perform one or more strength training exercises.

Figure 12B:
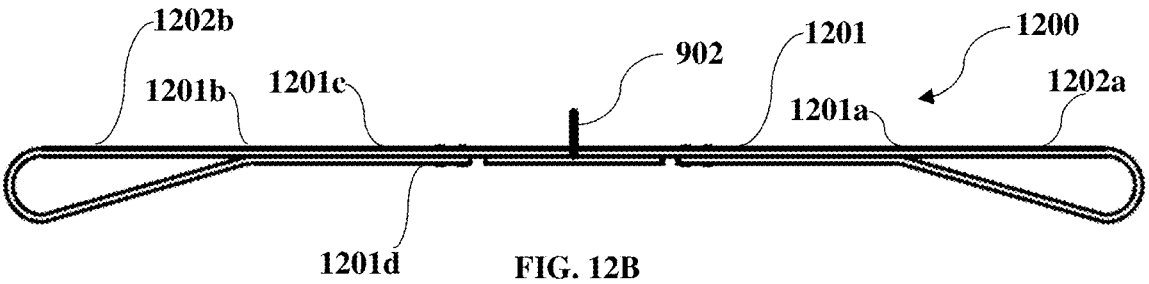
FIG. 12B illustrates a right-side elevation view of the training accessory inserted into the ring element shown in FIG. 12A, the left-side elevation view being a mirror image thereof.

FIG. 12B illustrates a right-side elevation view of the training accessory 1200 inserted into the ring element 902 shown in FIG. 12A, the left-side elevation view being a mirror image thereof. The right-side elevation view in FIG. 12B illustrates the loop elements 1202*a* and 1202*b* extending from the opposing ends 1201*a* and 1201*b* of the strap member 1201 of the training accessory 1200, respectively.

Figure 12C:
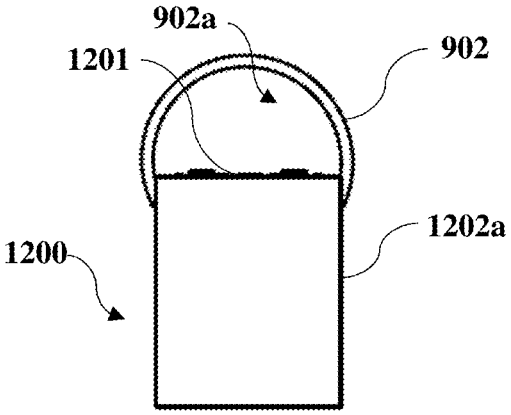
FIG. 12C illustrates a front elevation view of the training accessory inserted into the ring element shown in FIG. 12A, the rear elevation view being a mirror image thereof.

FIG. 12C illustrates a front elevation view of the training accessory 1200 inserted into the ring element 902 shown in FIG. 12A, the rear elevation view being a mirror image thereof. The front elevation view in FIG. 12C illustrates the opening 902*a* of the ring element 902 through which the training accessory 1200 is inserted.

Figure 12D:
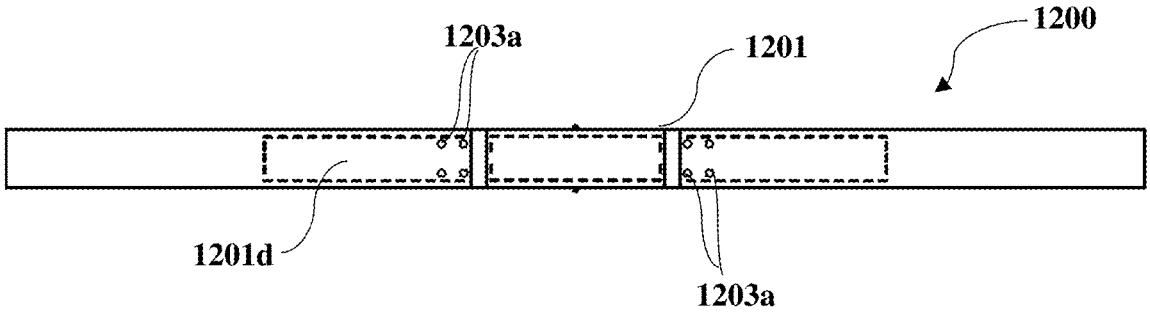
FIG. 12D illustrates a bottom elevation view of the training accessory shown in FIG. 12A.
Figure 12E:
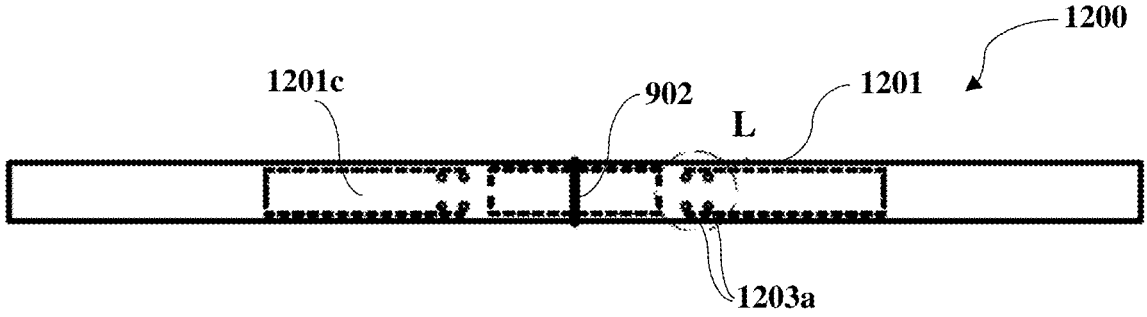
FIG. 12E illustrates a top plan view of the training accessory inserted into the ring element shown in FIG. 12A.

FIGS. 12D-12E illustrate a bottom elevation view and a top plan view of the training accessory 1200 inserted into the ring element 902 shown in FIG. 12A, respectively. FIGS. 12D-12E illustrate attachment of the loop elements 1202*a* and 1202*b* from the upper surface 1201*c* of the strap member 1201 to the lower surface 1201*d* of the strap member 1201 using the fasteners 1203*a*.

Figure 12F:
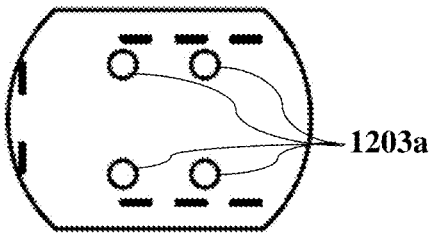
FIG. 12F illustrates an enlarged view of a portion marked L in FIG. 12A.

FIG. 12F illustrates an enlarged view of a portion marked L in FIG. 12A. The enlarged view in FIG. 12F illustrates the fasteners 1203*a* used to attach the loop elements 1202*a* and 1202*b* from the upper surface 1201*c* of the strap member 1201 to the lower surface 1201*d* of the strap member 1201 illustrated in FIGS. 12D-12E.

Figure 13A:
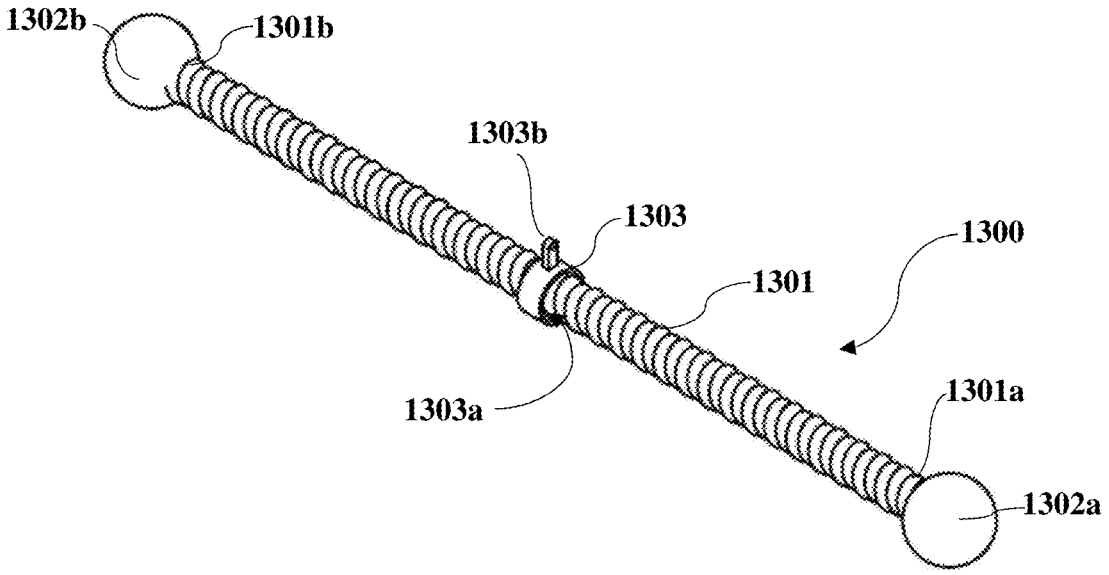
FIG. 13A illustrates a top perspective view of another training accessory inserted into a ring element attachable to the ring element of the embodiment of the top handle attachment shown in FIG. 10A.
Figure 13B:
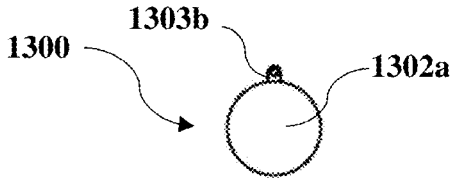
FIG. 13B illustrates a front elevation view of the training accessory inserted into the ring element shown in FIG. 13A, the rear elevation view being a mirror image thereof.

FIGS. 13A-13B illustrates a top perspective view and a front elevation view, respectively, of another training accessory 1300 inserted into a ring element 1303 attachable to the ring element 902 of the embodiment of the top handle attachment 901 shown in FIG. 10A, the rear elevation view being a mirror image of FIG. 13B. In an embodiment as illustrated in FIG. 13A, the training accessory 1300 is a rope accessory comprising a rope member 1301 with two knotted elements 1302*a* and 1302*b* disposed at the opposing ends 1301*a* and 1301*b* of the rope member 1301, respectively. The training accessory 1300 further comprises a tab 1303*b* attached to and extending upwardly from the ring element 1303. The tab 1303*b* is attachable to the ring element 902 of the top handle attachment 901 of the adjustable center mass weight apparatus 900 shown in FIG. 10A using a fastener, for example, a carabiner. After the adjustable center mass weight apparatus 900 illustrated in FIG. 10A is assembled, the tab 1303*b* of the ring element 1303 is attached to the ring element 902 of the top handle attachment 901. A user may then wrap the rope member 1301 around the hands and lift the adjustable center mass weight apparatus 900 to perform one or more strength training exercises.

Figure 13C:
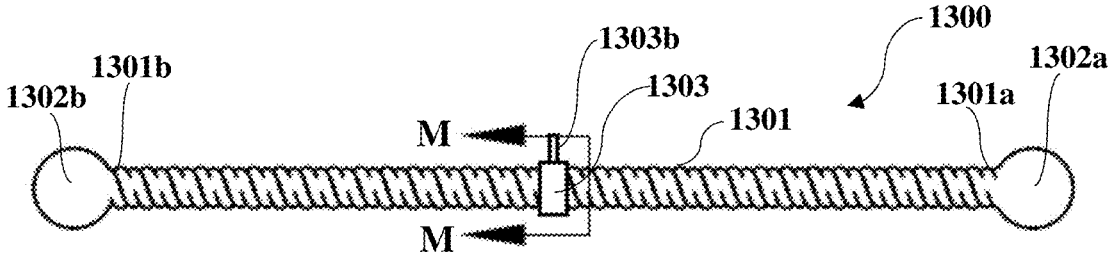
FIG. 13C illustrates a right-side elevation view of the training accessory inserted into the ring element shown in FIG. 13A, the left-side elevation view being a mirror image thereof.
Figure 13D:
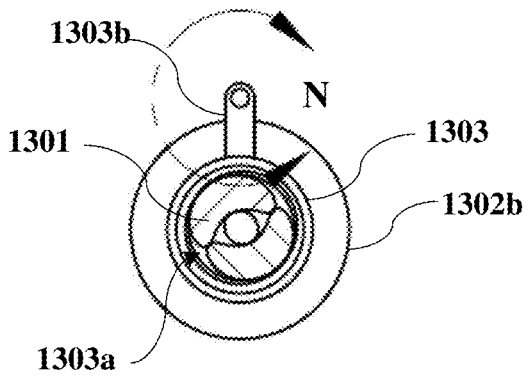
FIG. 13D illustrates a cross-sectional view of the training accessory inserted into the ring element shown in FIG. 13A, taken along a sectional line M-M shown in FIG. 13C.
Figure 13E:
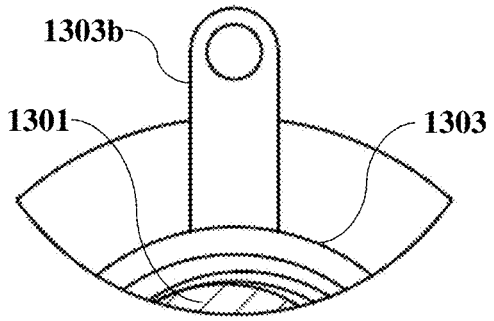
FIG. 13E illustrates an enlarged view of a portion marked N in FIG. 13D.

FIG. 13C illustrates a right-side elevation view of the training accessory 1300 inserted into the ring element 1303 shown in FIG. 13A, the left-side elevation view being a mirror image thereof. FIG. 13D illustrates a cross-sectional view of the training accessory 1300 inserted into the ring element 1303 shown in FIG. 13A, taken along a sectional line M-M in FIG. 13C. The cross-sectional view in FIG. 13D illustrates the rope member 1301 accommodated within an opening 1303*a* of the ring element 1303. FIG. 13E illustrates an enlarged view of a portion marked N in FIG. 13D. The enlarged view in FIG. 13E illustrates the tab 1303*b* extending upwardly from the ring element 1303.

Figure 14:
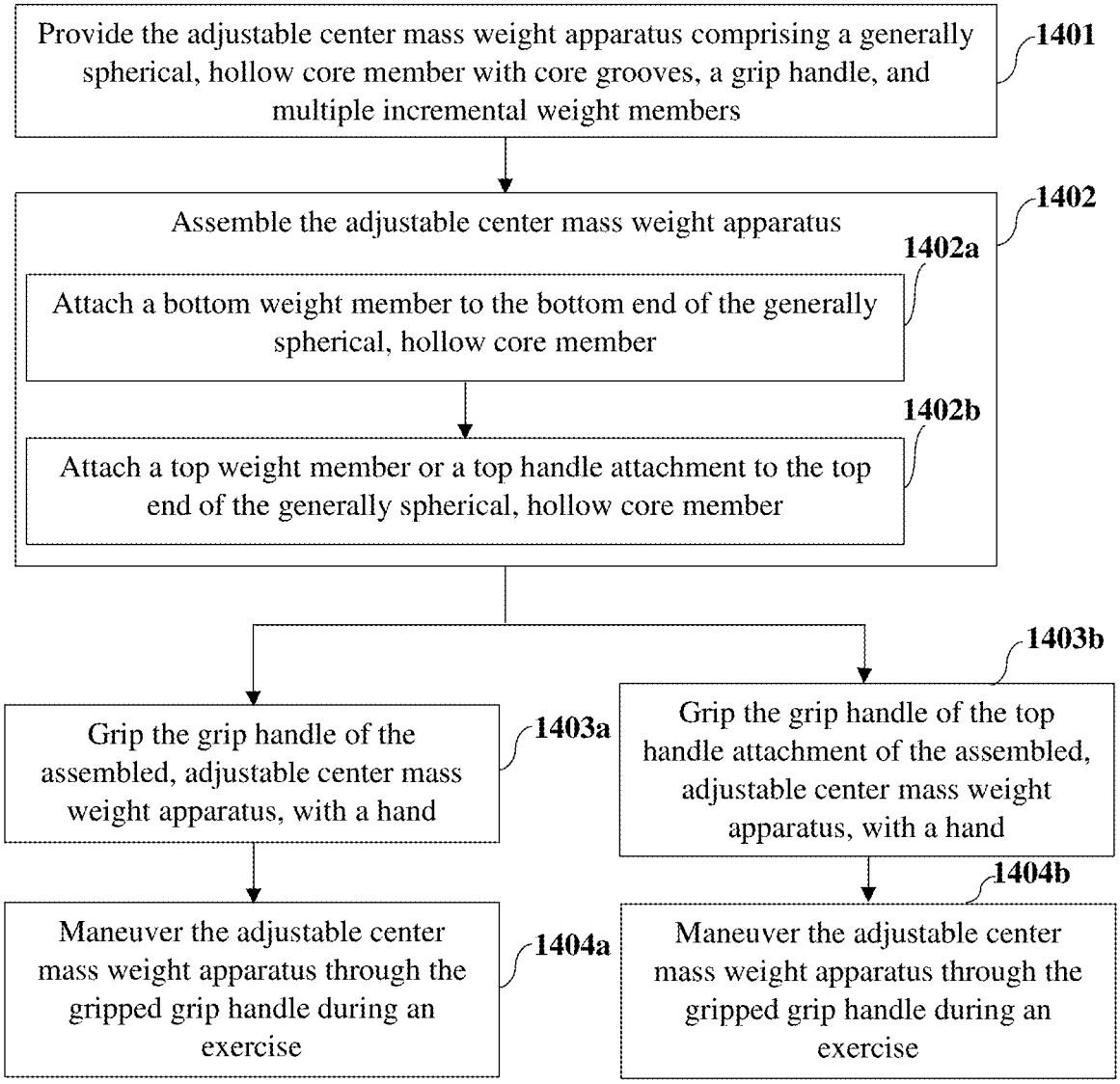
FIG. 14 illustrates a flowchart of an embodiment of a method for using the adjustable center mass weight apparatus.

FIG. 14 illustrates a flowchart of an embodiment of a method for using the adjustable center mass weight apparatus 100/600 shown in FIGS. 1A-1C, FIG. 2A-2D, FIG. 6, and FIGS. 7A-7E. In the method disclosed herein, the adjustable center mass weight apparatus 100/600 comprising a generally spherical, hollow core member 101 with core grooves 106*a* and 106*b*, a grip handle 103/602, and incremental weight members such as the top weight member 107, the bottom weight member 109, and the top handle attachment 601 as disclosed in the detailed descriptions of FIGS. 1A-1C, FIGS. 2A-2D, FIG. 6, and FIGS. 7A-7E, is provided 1401. The adjustable center mass weight apparatus 100/600 is assembled 1402 by attaching 1402*a* the bottom weight member 109 to the bottom end 101*b* of the core member 101 illustrated in FIGS. 1B-1C, and attaching 1402*b* the top weight member 107 or the top handle attachment 601 to the top end 101*a* of the core member 101 illustrated in FIG. 1A and FIG. 6. The top handle attachment 601 converts the adjustable center mass weight apparatus 100/600 into a kettlebell. The bottom weight member 109 is attached to the bottom end 101*b* of the core member 101 by engaging the core grooves 106*b* at the bottom end 101*b* of the core member 101 illustrated in FIGS. 1B-1C with corresponding weight grooves 111 of the bottom weight member 109 illustrated in FIG. 1A and FIG. 6.

Consider an example where the top weight member 107 is attached to the top end 101*a* of the core member 101 by engaging the weight grooves 113 of the top weight member 107 illustrated in FIGS. 1B-1C, with the core grooves 106*a* at the top end 101*a* of the core member 101 illustrated in FIG. 1A, to complete the assembly the adjustable center mass weight apparatus 100 illustrated in FIG. 2A. The grip handle 103 of the assembled, adjustable center mass weight apparatus 100 is then gripped 1403*a* by a user's hand. To grip 1403*a* the grip handle 103 disposed centrally inside the cavity 102 of the core member 101 of the assembled, adjustable center mass weight apparatus 100, the user inserts a hand into the cavity 102 of the core member 101 and grasps the grip handle 103. The grip handle 103 is configured to distribute weight of the adjustable center mass weight apparatus 100 evenly around the user's hand. The user then maneuvers 1404*a*, for example, lifts or lowers, the adjustable center mass weight apparatus 100 through the gripped grip handle 103 during one or more of multiple exercises, for example, bench presses, overhead presses, swings, rows, lunges, squats, twists, etc. The design of the adjustable center mass weight apparatus 100 defines an optimal geometric shape that enables the weight of the adjustable center mass weight apparatus 100 to become a part of the user's body, making it possible to perform exercises such as a lunge to reach at ground height, a bent-over row or a rotational uppercut with greater improvement than conventional weight apparatuses, for example, dumbbells.

Consider another example where the top handle attachment 601 is attached to the top end 101*a* of the core member 101 by engaging the handle grooves 605 of the top handle attachment 601 illustrated in FIG. 8C, with the core grooves 106*a* at the top end 101*a* of the core member 101 to complete the assembly the adjustable center mass weight apparatus 600 illustrated in FIG. 7A. The top handle attachment 601 of the assembled, adjustable center mass weight apparatus 600 is then gripped 1403*b* by a user's hand. To grip 1403*b* the top handle attachment 601 of the assembled, adjustable center mass weight apparatus 600 illustrated in FIG. 7A, the user grasps the upwardly extending grip handle 602 of the top handle attachment 601. The user then maneuvers 1404*b*, for example, lifts or lowers, the adjustable center mass weight apparatus 600 through the gripped grip handle 602 during one or more of multiple exercises, for example, bench presses, overhead presses, swings, rows, lunges, squats, twists, etc.

The adjustable center mass weight apparatus 100/600 is manufactured using different injection molding and/or casting technologies, for example, cast iron molding, lost foam casting, green sand casting, etc. The weight of the adjustable center mass weight apparatus 100 being evenly distributed all the way around a user's hand gripping the grip handle 103, makes the adjustable center mass weight apparatus 100 safe and more effective than conventional weight apparatuses for strength training exercises. Because the user's hand is completely enclosed by the adjustable center mass weight apparatus 100, there is no impact or there is reduced impact on wrists, hands, shoulders, and/or other easily destabilized joints or muscle groups and no risk of having fingers pinched or smashed when placing the adjustable center mass weight apparatus 100 back on a rack at the end of a fatiguing set. The adjustable center mass weight apparatus 100/600/900 addresses dynamic training needs of users who want to be able to generate force and move loads in all directions. Having an adjustable center mass weight apparatus 100 that can easily make the transition between a single-hand use and a two-hand use, in addition to increasing or decreasing weights as required or converting the adjustable center mass weight apparatus 100 into another adjustable center mass weight apparatus 600/900, allows performance of a wide variety of exercises, for example, presses, swings, lunges, snatches, cleans, rows, etc., by users at different skill levels. With the improved, compact design of the adjustable center mass weight apparatus 100/600/900, smaller facilities can subsequently save valuable space while creating a more refined, upscale environment in these facilities. The adjustable center mass weight apparatus 100/600/900 creates a safe training and storage environment with cost savings and without the clutter of multiple pieces of equipment. In an example, the adjustable center mass weight apparatus 100/600/900 comprises a set of only 8 pieces compared to a full set of the center mass bells which typically comprise about 30 pieces of equipment, thereby costing less and taking up considerably less space. The adjustable center mass weight apparatus 100/600/900 improves the ability of the user to train in a safe manner and increases training effectiveness.

The foregoing examples and illustrative implementations of various embodiments have been provided merely for explanation and are in no way to be construed as limiting the embodiments disclosed herein. Dimensions of various parts of the adjustable center mass weight apparatus 100/600/900 disclosed above are exemplary, and are not limiting of the scope of the embodiments herein. While the embodiments have been described with reference to various illustrative implementations, drawings, and techniques, it is understood that the words, which have been used herein, are words of description and illustration, rather than words of limitation. Furthermore, although the embodiments have been described herein with reference to particular means, materials, techniques, and implementations, the embodiments herein are not intended to be limited to the particulars disclosed herein; rather, the embodiments extend to all functionally equivalent structures, methods and uses, such as are within the scope of the appended claims. It will be understood by those skilled in the art, having the benefit of the teachings of this specification, that the embodiments disclosed herein are capable of modifications and other embodiments may be effected and changes may be made thereto, without departing from the scope and spirit of the embodiments disclosed herein.

We claim:

1. An adjustable center mass weight apparatus comprising:

a generally spherical, hollow core member defining a cavity therewithin, between a top end and a bottom end of the generally spherical, hollow core member, wherein the cavity is configured to accommodate a hand of a user and movements of the hand therewithin;

a grip handle disposed centrally inside the cavity of the generally spherical, hollow core member, along a horizontal axis transverse to a central axis of the generally spherical, hollow core member, wherein the grip handle is configured to be gripped by the hand of the user and to distribute weight of the adjustable center mass weight apparatus evenly around the hand of the user;

a plurality of core grooves disposed at the top end and the bottom end of the generally spherical, hollow core member; and a plurality of incremental weight members configured to engage with the plurality of core grooves at the top end and the bottom end of the generally spherical, hollow core member, without disrupting weight distribution of the grip handle.

2. The adjustable center mass weight apparatus of claim 1, wherein the plurality of incremental weight members comprises a top weight member and a bottom weight member, wherein the top weight member is configured to engage with the plurality of core grooves at the top end of the generally spherical, hollow core member, and wherein the bottom weight member is configured to engage with the core grooves at the bottom end of the generally spherical, hollow core member.

3. The adjustable center mass weight apparatus of claim 2, wherein the top weight member is a generally spherical cap comprising:

an opening configured at a top end of the top weight member and configured to be in fluid communication with the cavity of the generally spherical, hollow core member, wherein the opening is configured to accommodate the hand and a wrist of the user and the movements of the hand and the wrist within the cavity of the generally spherical, hollow core member; and weight grooves configured on a bottom end of the top weight member, wherein the weight grooves of the top weight member are configured to engage with the plurality of core grooves at the top end of the generally spherical, hollow core member to attach the top weight member to the top end of the generally spherical, hollow core member.

4. The adjustable center mass weight apparatus of claim 3, wherein a diameter of the opening of the top weight member is from about 4 inches to about 8 inches.

5. The adjustable center mass weight apparatus of claim 2, wherein the bottom weight member is a generally spherical cap comprising weight grooves configured on a protruding section extending outwardly from a top end of the bottom weight member, wherein the weight grooves of the bottom weight member are configured to engage with the plurality of core grooves at the bottom end of the generally spherical, hollow core member to attach the bottom weight member to the bottom end of the generally spherical, hollow core member.

6. The adjustable center mass weight apparatus of claim 2, wherein dimensions of the top weight member comprise:

an outer diameter ranging from about 4 inches to about 8 inches;

a height ranging from about 1.5 inches to about 4 inches; and a weight ranging from about 5 pounds to about 10 pounds.

7. The adjustable center mass weight apparatus of claim 2, wherein dimensions of the bottom weight member comprise:

an outer diameter ranging from about 4 inches to about 8 inches;

a height ranging from about 1.5 inches to about 4 inches; and a weight ranging from about 5 pounds to about 10 pounds.

8. The adjustable center mass weight apparatus of claim 1, wherein the plurality of incremental weight members comprises a top handle attachment and a bottom weight member, wherein the bottom weight member is configured to engage with the plurality of core grooves at the bottom end of the generally spherical, hollow core member.

9. The adjustable center mass weight apparatus of claim 8, wherein the top handle attachment is configured to convert the adjustable center mass weight apparatus into another weight apparatus, and wherein the top handle attachment comprises:

a support member;

a second grip handle attached to and extending upwardly from a top end of the support member;

a protruding section extending outwardly from a bottom end of the support member; and handle grooves configured on the protruding section of the top handle attachment, wherein the handle grooves are configured to engage with the plurality of core grooves at the top end of the generally spherical, hollow core member to attach the top handle attachment to the top end of the generally spherical, hollow core member.

10. The adjustable center mass weight apparatus of claim 8, wherein the bottom weight member is a generally spherical cap comprising weight grooves configured on a protruding section extending outwardly from a top end of the bottom weight member, wherein the weight grooves of the bottom weight member are configured to engage with the plurality of core grooves at the bottom end of the generally spherical, hollow core member to attach the bottom weight member to the bottom end of the generally spherical, hollow core member.

11. The adjustable center mass weight apparatus of claim 8, wherein dimensions of the bottom weight member comprise:

an outer diameter ranging from about 4 inches to about 8 inches;

a height ranging from about 1.5 inches to about 4 inches; and a weight ranging from about 5 pounds to about 10 pounds.

12. The adjustable center mass weight apparatus of claim 8, wherein the top handle attachment comprises a ring element, a support member, and a protruding section, wherein the ring element is attached to and extends upwardly from a top end of the support member and comprises an opening configured to receive a training accessory, wherein the protruding section extends outwardly from a bottom end of the support member and comprises handle grooves configured to engage with the plurality of core grooves at the top end of the generally spherical, hollow core member to attach the top handle attachment to the top end of the generally spherical, hollow core member.

13. The adjustable center mass weight apparatus of claim 1, wherein the top end of the generally spherical, hollow core member comprises an opening extending inwardly from the top end of the generally spherical, hollow core member into the cavity of the generally spherical, hollow core member, and wherein the plurality of core grooves comprises inner grooves configured on the inwardly extending opening of the generally spherical, hollow core member.

14. The adjustable center mass weight apparatus of claim 1, wherein the bottom end of the generally spherical, hollow core member comprises an opening extending inwardly from the bottom end of the generally spherical, hollow core member, and wherein the plurality of core grooves comprises inner grooves configured on the inwardly extending opening of the generally spherical, hollow core member.

15. The adjustable center mass weight apparatus of claim 1, wherein dimensions of the generally spherical, hollow core member comprise:

an outer diameter ranging from about 7.48 inches to about 9.84 inches;

a height ranging from about 7 inches to about 12 inches; and a weight ranging from about 20 pounds to about 120 pounds.

16. The adjustable center mass weight apparatus of claim 1, wherein dimensions of the grip handle comprise:

a length ranging from about 4 inches to about 6.5 inches; and a diameter ranging from about 1.46 inches to about 1.57 inches.

17. The adjustable center mass weight apparatus of claim 1, wherein a cross-section of the grip handle is one of a circular cross-section, an oblong cross-section, and an ovoid cross-section.

18. A method for using an adjustable center mass weight apparatus, the method comprising:

providing the adjustable center mass weight apparatus comprising:

a generally spherical, hollow core member defining a cavity therewithin, between a top end and a bottom end of the generally spherical, hollow core member;

a grip handle disposed centrally inside the cavity of the generally spherical, hollow core member, along a horizontal axis transverse to a central axis of the generally spherical, hollow core member;

a plurality of core grooves disposed at the top end and the bottom end of the generally spherical, hollow core member; and a plurality of incremental weight members configured to engage with the plurality of core grooves at the top end and the bottom end of the generally spherical, hollow core member, without disrupting weight distribution of the grip handle, wherein the plurality of incremental weight members comprises a top weight member, a bottom weight member, and a top handle attachment;

assembling the adjustable center mass weight apparatus, comprising:

attaching the bottom weight member to the bottom end of the generally spherical, hollow core member by engaging the plurality of core grooves at the bottom end of the generally spherical, hollow core member with corresponding weight grooves of the bottom weight member; and attaching one of the top weight member and the top handle attachment to the top end of the generally spherical, hollow core member by engaging the plurality of core grooves at the top end of the generally spherical, hollow core member with corresponding grooves of the one of the top weight member and the top handle attachment;

gripping one of the grip handle and the top handle attachment of the assembled, adjustable center mass weight apparatus, with a hand of a user, wherein the grip handle is configured to distribute weight of the adjustable center mass weight apparatus evenly around the hand of the user, and wherein the top handle attachment is configured to convert the adjustable center mass weight apparatus into another weight apparatus; and maneuvering the adjustable center mass weight apparatus through the gripped one of the grip handle and the top handle attachment during one or more of a plurality of exercises.

19. The method of claim 18, wherein the top handle attachment comprises a ring element with an opening configured to receive a training accessory for executing the one or more of the plurality of exercises.

* * * * *